US007187347B2

(12) United States Patent
Tanaka et al.

(10) Patent No.: US 7,187,347 B2
(45) Date of Patent: Mar. 6, 2007

(54) PLASMA DISPLAY PANEL AND METHOD OF DRIVING THE SAME

(75) Inventors: Yoshito Tanaka, Tokyo (JP); Takashi Furutani, Tokyo (JP)

(73) Assignee: Pioneer Corporation, Tokyo (JP)

( * ) Notice: Subject to any disclaimer, the term of this patent is extended or adjusted under 35 U.S.C. 154(b) by 636 days.

(21) Appl. No.: 10/730,898

(22) Filed: Dec. 10, 2003

(65) Prior Publication Data

US 2005/0128166 A1 Jun. 16, 2005

(30) Foreign Application Priority Data

Dec. 10, 2002 (JP) ..... 2002-357518

(51) Int. Cl.
*G09G 3/28* (2006.01)

(52) U.S. Cl. ..... 345/60; 345/37; 345/67; 315/169.1

(58) Field of Classification Search ..... 345/37, 345/41, 60–67; 315/169.1, 169.3, 169.4
See application file for complete search history.

(56) References Cited

U.S. PATENT DOCUMENTS

| | | | | |
|---|---|---|---|---|
| 5,420,602 | A * | 5/1995 | Kanazawa | 345/67 |
| 6,768,478 | B1 * | 7/2004 | Wani et al. | 345/60 |
| 6,882,116 | B2 * | 4/2005 | Araki | 315/169.4 |
| 2002/0171609 | A1 * | 11/2002 | Tanaka | 345/60 |
| 2002/0186186 | A1 * | 12/2002 | Hashimoto et al. | 345/63 |
| 2003/0034937 | A1 * | 2/2003 | Kim | 345/63 |
| 2003/0184502 | A1 * | 10/2003 | Makino | 345/60 |
| 2003/0234753 | A1 * | 12/2003 | Tanaka | 345/67 |
| 2004/0095294 | A1 * | 5/2004 | Yamada | 345/60 |
| 2004/0113871 | A1 * | 6/2004 | Kashio et al. | 345/63 |
| 2004/0164930 | A1 * | 8/2004 | Hashimoto et al. | 345/60 |

FOREIGN PATENT DOCUMENTS

| | | | |
|---|---|---|---|
| JP | 2000-11899 | A | 1/2000 |
| JP | 2000-123750 | A | 4/2000 |
| JP | 2001-76625 | A | 3/2001 |
| JP | 2002-100294 | A | 4/2002 |
| KR | 2001-104080 | A | 11/2001 |

* cited by examiner

*Primary Examiner*—Richard Hjerpe
*Assistant Examiner*—Kimnhung Nguyen
(74) *Attorney, Agent, or Firm*—Sughrue Mion, PLLC

(57) ABSTRACT

A plasma display panel includes (a) first and second substrates facing each other, (b) a plurality of first electrodes formed on the first substrate and extending in parallel with one another, (c) a plurality of second electrodes formed on the second substrate and extending in parallel with one another perpendicularly to the first electrodes, and (d) a plurality of display cells arranged at intersections of the first electrodes with the second electrodes, wherein a first selection pulse is input into the first electrodes and a second selection pulse is input selectively into one or more of the second electrodes to thereby control whether light is to be emitted in each of the display cells, and at least one of the display cells has a third electrode formed on the first substrate and being electrically connected to a first electrode other than a first electrode belonging to a display cell to which the third electrode belongs.

30 Claims, 16 Drawing Sheets

PLASMA DISPLAY PANEL AND METHOD OF DRIVING THE SAME

BACKGROUND OF THE INVENTION

1. Field of the Invention

The invention relates to a plasma display panel, and more particularly to a plasma display panel and a method of driving the same both of which are capable of stably displaying images even when much images are to be displayed.

2. Description of the Related Art

A conventional plasma display panel, a conventional method of driving the same and a conventional method of controlling a luminance in a plasma display panel are explained hereinbelow with reference to FIGS. 1 to 3.

FIG. 1 is a perspective broken view of a conventional plasma display panel suggested in Japanese Patent Application Publications Nos. 2000-11899 and 2001-76625, for instance.

A plasma display panel includes an electrically insulating front substrate 1A and an electrically insulating rear substrate 1B both of which are composed of glass.

On the electrically insulating front substrate 1A are formed transparent scanning electrodes 2 and transparent sustaining electrodes 3, and trace electrodes 4 composed of metal are formed on the scanning and sustaining electrodes 2 and 3 in order to reduce a resistance of the scanning and sustaining electrodes 2 and 3.

A first dielectric layer 9 is formed on the electrically insulating front substrate 1A such that the scanning and sustaining electrodes 2 and 3 are entirely covered with the first dielectric layer 9. On the dielectric layer 9 is formed a protection layer 10 for protecting the dielectric layer 9 from discharges. The protection layer 10 is composed of magnesium oxide, for instance.

On the electrically insulating rear substrate 1B are formed data electrodes 5 extending perpendicularly to the scanning and sustaining electrodes 2 and 3. A second dielectric layer 11 is formed on the electrically insulating rear substrate 1B such that the data electrodes 5 are entirely covered with the second dielectric layer 11.

On the second dielectric layer 11 are formed partition walls 12 extending in parallel with the data electrodes 5 and defining display cells (see FIG. 2) as units for displaying images.

Sidewalls of the partition walls and an exposed surface of the second dielectric layer 11 are covered with a phosphor layer 8 which converts ultra-violet rays generated by discharge in discharge gas, into visible light.

Spaces 6 sandwiched between the electrically insulating front and rear substrates 1A and 1B and partitioned by the partition walls 7 define discharge spaces 6 filled with helium (He), neon (Ne) or xenon (Xe) alone or in combination.

In the plasma display panel having the above-mentioned structure, surface discharge 100 is generated between the scanning electrodes 2 and the sustaining electrodes 3.

FIG. 2 is a plan view of the plasma display panel illustrated in FIG. 1, as viewed from a viewer.

A scanning electrode 2 and two sustaining electrodes 3 located adjacent thereto form two gaps therebetween, one of which is a primary discharge gap MG in which discharge is generated, and the other of which is a non-discharge gap SG in which discharge is not generated. Thus, a unit display cell 12 is defined by the partition walls 7 and the non-discharge gap SG.

The non-discharge gap SG is designed relatively long in order to reduce interference in discharges generated in display cells adjacent to each other in a direction in which the partition walls 7 extend. The non-discharge gap SG is generally designed four or five times longer than the primary discharge gap MG.

In order to reduce interference in discharges generated in display cells adjacent to each other in a direction in which the partition walls 7 extend, the partition walls 7 may be formed in the non-discharge gap SG.

Hereinbelow is explained a display operation of a display cell.

FIG. 3 is a timing chart showing waveforms of voltage pulses to be applied to electrodes in a conventional method of driving a plasma display panel.

As illustrated in FIG. 3, a fundamental cycle for driving the plasma display panel includes a preliminary discharge period (A) in which display cells are reset for causing discharges to be readily generated in the subsequent period (B), a scanning period (B) in which it is selected which display cell or cells is(are) to be turned on or off, a sustaining period (C) in which discharges are generated in all of the selected display cells, and a sustaining-elimination period (D) in which the discharges having been generated in the sustaining period (C) are terminated. Such a fundamental cycle is called a sub-field.

In the conventional method of driving a plasma display panel, reference voltages of surface electrodes comprised of the scanning and sustaining electrodes 2 and 3 are set equal to a sustaining voltage Vos to keep discharges generated in the sustaining period (C). Accordingly, with respect to the scanning and sustaining electrodes 2 and 3, a voltage higher than the sustaining voltage Vos is a positive voltage, and a voltage lower than the sustaining voltage Vos is a negative voltage. With respect to the data electrodes 5, a reference voltage is set equal to zero (0) volt.

In the preliminary discharge period (A), a positive serrate preliminary discharge pulse Pops is applied to the scanning electrodes 2, and concurrently, a negative rectangular preliminary discharge pulse Popc is applied to the sustaining electrodes 3.

The preliminary discharge pulse Pops is designed to have a wave-height greater than a threshold voltage at which discharge starts being generated between the scanning and sustaining electrodes 2 and 3. Hence, weak discharge is generated between the scanning and sustaining electrodes 2 and 3 when the preliminary discharge pulses Pops and Popc are applied to the scanning and sustaining electrodes 2 and 3, and, a voltage of the serrate preliminary discharge pulse Pops raises, thereby a voltage between the scanning and sustaining electrodes 2 and 3 exceeds the above-mentioned threshold voltage. As a result, negative wall charges are accumulated above the scanning electrodes 2, and positive wall charges are accumulated above the sustaining electrodes 3.

Following the preliminary discharge pulse Pops, a negative serrate preliminary discharge-eliminating pulse Pope is applied to the scanning electrodes 2. The sustaining electrodes 3 are kept at the sustaining voltage Vos.

By applying the negative serrate preliminary discharge-eliminating pulse Pope to the scanning electrodes 2, wall charges having been accumulated above the scanning and sustaining electrodes 2 and 3 are eliminated.

Herein, the term "eliminate" should not be limited to elimination of all of wall charges, but should be interpreted as including reduction in wall charges for smoothly generating discharges in the scanning period (B) and the sustaining period (C).

In the scanning period (B), all of the scanning electrodes 2 are kept at a base voltage Vobw, and then, a negative scanning pulse Pow is applied to the scanning electrodes 2 one by one, and concurrently, a data pulse Pod is applied to the data electrodes 5 in accordance with data to be displayed. The sustaining electrode 3 is kept at a positive voltage Vosw.

Ultimate voltages of the scanning pulse Pow and the data pulse Pod are determined such that a voltage across the scanning and data electrodes 2 and 5 does not exceed a threshold voltage at which discharge is generated between the scanning and data electrodes 2 and 5, if only one of the scanning pulse Pow and the data pulse Pod is applied to the scanning or data electrodes 2 or 5, but exceeds the threshold voltage, if both of the scanning pulse Pow and the data pulse Pod are applied to the scanning and data electrodes 2 and 5.

The voltage Vosw at which the sustaining electrodes 3 are kept in the scanning period (B) is determined such that a voltage across the scanning and sustaining electrodes 2 and 3 does not exceed a threshold voltage at which discharge is generated between the scanning and sustaining electrodes 2 and 3, even if the voltage Vosw is added to the scanning pulse Pow.

Accordingly, cross-discharge is generated between the scanning and data electrodes 2 and 5 only in a display cell in which the scanning pulse Pow is applied to the scanning electrodes 2 and the data pulse Pod is applied to the data electrodes 5.

When cross-discharge is generated between the scanning and data electrodes 2 and 5, since a voltage caused by the scanning pulse Pow and the voltage Vosw is applied across the scanning and sustaining electrodes 2 and 3, there is generated discharge also between the scanning and sustaining electrodes 2 and 3 with the cross-discharge acting as a trigger. The thus generated discharge is data-writing discharge.

As a result, positive wall charges are accumulated above the scanning electrode 2, and negative wall charges are accumulated above the sustaining electrodes 3 in a selected display cell.

Then, all of the scanning electrodes 2 are kept at the sustaining voltage Vos, and a first sustaining pulse Posf is applied to the sustaining electrode 3 in the sustaining period (C).

The sustaining voltage Vos is determined to be such a voltage that if a voltage caused by wall charges accumulated above the surface electrodes by data-writing discharge in the scanning period (B) is added to the sustaining voltage Vos, discharge will be generated, and if not, a voltage across the surface electrodes will not exceed a threshold voltage, and hence, discharge is generated between the surface electrodes.

Accordingly, sustaining voltage is generated only in a display cell in which there has been generated data-writing discharge in the scanning period (B), and hence, wall charges have been accumulated on above the surface electrodes.

Then, sustaining pulses Pos having a wave-height equal to the sustaining voltage Vos and having phases inverted to each other are applied to the scanning and sustaining electrodes 2 and 3. As a result, there is generated sustaining voltage only in a display cell in which discharge has been generated by the first sustaining pulse Posf.

In the subsequent sustaining period (D), the sustaining electrodes 3 are kept at the sustaining voltage Vos, and a negative serrate sustaining-elimination pulse Poe is applied to the scanning electrodes 2. As a result, wall charges having been accumulated above the surface electrodes are eliminated, and hence, the plasma display panel is returned back to its initial condition, that is, a condition observed prior to the application of the preliminary discharge pulses Pops and Popc to the scanning and sustaining electrodes 2 and 3 in the preliminary discharge period (A).

Herein, the term "eliminate" should not be limited to elimination of all of wall charges, but should be interpreted as including reduction in wall charges for smoothly generating discharges in the subsequent periods.

In the above-mentioned method, the scanning period (B) and the sustaining period (C) are temporally separated from each other. In some methods of driving a plasma display panel, steps to be carried out in the scanning and sustaining periods are carried out in temporally mixed condition. However, it is common in each of display cells that a preliminary discharge period, a scanning period and a sustaining period are carried out in this order.

Hereinbelow is explained a conventional method of controlling a luminance in a plasma display panel.

In a plasma display panel, images are displayed at gray scales in accordance with a sub-field process. This is because it is difficult to control a luminance of light-emission by modulating a voltage, and hence, it is necessary to vary a number of light-emission for controlling a luminance in a conventional AC type plasma display panel.

Herein, a sub-field process is a process in which a picture to be displayed with gray scales is divided into a plurality of binary images, and those binary images are successively displayed at a high speed to thereby reproduce the picture with gray scales by virtue of visual storage effect.

A picture is displayed generally in 1/60 seconds, and this is called one field. When images are displayed at 8 bit and 256 gray scales, one field is divided into eight sub-fields (SFs), and a luminance ratio 1: 2: 4: 8: 16: 32: 64: 128 is assigned to the sub-fields. Thus, by selecting a sub-field(s) in which light-emission is carried out in a selected display cell(s), in accordance with a luminance level of input signal, it would be possible to display images at a plurality of gray scales.

Each of the sub-fields is comprised of four periods, that is, the preliminary discharge period (A), the scanning period (B), the sustaining period (C) and the sustaining-elimination period (D). A luminance in each of the sub-fields can be controlled by varying a number of sustaining cycles in the sustaining period (C).

A number of sub-fields may be set greater than a number of bits in a gray scale to provide redundancy. This is advantageous for suppressing moving picture pseudo-frame, which is one of defectiveness unique to a plasma display panel.

A plasma display panel is required to have high accuracy for enhancing display quality.

In the above-mentioned conventional method of driving a plasma display panel, if a number of display lines is increased by accomplishing high accuracy, it is unavoidable that the scanning period (B) is rendered longer, and accordingly, the sustaining period (C) is rendered shorter.

For instance, it is assumed that a scanning pulse has a pulse width of 2 microseconds.

If VGA having 480 display lines is displayed in eight sub-fields, the scanning period (B) would be 7.68 milliseconds (2 μs×480×8=7.68 ms). Thus, the scanning period (B) occupies about 46% of one field.

If XGA having 768 display lines is displayed in eight sub-fields, the scanning period (B) would be 7.68 milliseconds (2 μs×768×8=12.288 ms). Thus, the scanning period (B) occupies about 74% of one field, which is equal to about a half of the same in VGA.

The reduction of the sustaining period (C) in duration causes a problem that a display luminance is reduced.

Furthermore, if a number of sub-fields is increased for suppressing moving picture pseudo-frame, there is caused a problem that the scanning period (B) is rendered longer, and hence, the sustaining period (C) is rendered shorter accordingly.

In order to avoid the scanning period (B) from being rendered longer when a number of display lines or a number of sub-fields is increased, for instance, a scanning pulse is designed to have a short width.

However, a short width of a scanning pulse causes a problem that a ratio at which data-writing discharge is generated is reduced, resulting in that images cannot be properly displayed.

Japanese Patent Application Publication No. 2000-123750 has suggested a plasma display panel including a front substrate and a rear substrate. A plurality of first electrodes is formed on the rear substrate, and a plurality of second and third electrodes are formed on the front substrate. At least one preliminary electrode is formed on the front substrate in parallel with the second and third electrodes.

Japanese Patent Application Publication No. 2002-100294 based on U.S. patent application Ser. No. 09/629,118 filed on Jul. 31, 2000 has suggested a plasma display panel including an upper glass substrate on which first and second sustaining electrodes are formed, and at least one preliminary electrode is further formed in parallel with the first and second sustaining electrodes. The preliminary electrode is adjacent to the first sustaining electrode.

SUMMARY OF THE INVENTION

In view of the above-mentioned problems in the conventional plasma display panels, it is an object of the present invention to provide a plasma display panel and a method of driving the same both of which capable of shortening a scanning period and providing high accuracy with which images are displayed, without reduction in a ratio of generation of data-writing discharges.

In one aspect of the present invention, there is provided a plasma display panel including (a) a first substrate, (b) a second substrate facing the first substrate, (c) a plurality of first electrodes formed on a surface of the first substrate which surface faces the second electrode, the first electrodes extending in parallel with one another in a first direction, and each having an input terminal through which a pulse is input thereinto, (d) a plurality of second electrodes formed on a surface of the second substrate which surface faces the first electrode, the second electrodes extending in parallel with one another in a second direction perpendicular to the first direction, and each having an input terminal through which a pulse is input thereinto, and (e) a plurality of display cells arranged at intersections of the first electrodes with the second electrodes, wherein a first selection pulse is input into the first electrodes and a second selection pulse is input selectively into one or more of the second electrodes to thereby control whether light is to be emitted in each of the display cells, and at least one of the display cells has a third electrode formed on the first substrate and being electrically connected to a first electrode other than a first electrode belonging to a display cell to which the third electrode belongs.

It is preferable that the third electrode is at least partially composed of a material which does not allow a visible light to pass therethrough.

There is further provided a plasma display panel including (a) a first substrate, (b) a second substrate facing the first substrate, (c) a plurality of first electrodes formed on a surface of the first substrate which surface faces the second electrode, the first electrodes extending in parallel with one another in a first direction, and each having an input terminal through which a pulse is input thereinto, (d) a plurality of second electrodes formed on a surface of the second substrate which surface faces the first electrode, the second electrodes extending in parallel with one another in a second direction perpendicular to the first direction, and each having an input terminal through which a pulse is input thereinto, (e) a plurality of fourth electrodes extending in parallel with the first electrodes with a primary discharge gap being sandwiched therebetween, and (f) a plurality of display cells arranged at intersections of the first and fourth electrodes with the second electrodes, wherein a first selection pulse is input into the first electrodes and a second selection pulse is input selectively into one or more of the second electrodes to thereby control whether light is to be emitted in each of the display cells, and at least one of the display cells has a third electrode formed on the first substrate and being electrically connected to a first electrode other than a first electrode belonging to a display cell to which the third electrode belongs.

It is preferable that the third and fourth electrodes form a preliminary display gap therebetween.

It is preferable that the third and fourth electrodes are at least partially composed of a material which does not allow a visible light to pass therethrough.

The plasma display panel may further include a light-shielding layer formed at least partially on the first substrate in alignment with the preliminary discharge gap, the light-shielding layer having opaqueness to a visible light.

There is further provided a plasma display panel including (a) a first substrate, (b) a second substrate facing the first substrate, (c) a plurality of first electrodes formed on a surface of the first substrate which surface faces the second electrode, the first electrodes extending in parallel with one another in a first direction, and each having an input terminal through which a pulse is input thereinto, (d) a plurality of second electrodes formed on a surface of the second substrate which surface faces the first electrode, the second electrodes extending in parallel with one another in a second direction perpendicular to the first direction, and each having an input terminal through which a pulse is input thereinto, (e) a plurality of fourth electrodes extending in parallel with the first electrodes with a primary discharge gap being sandwiched therebetween, (f) a plurality of fifth electrodes extending in parallel with the first and fourth electrodes, and (g) a plurality of display cells arranged at intersections of the first and fourth electrodes with the second electrodes, wherein a first selection pulse is input into the first electrodes and a second selection pulse is input selectively into one or more of the second electrodes to thereby control whether light is to be emitted in each of the display cells, and at least one of the display cells has a third electrode formed on the first substrate and being electrically connected to a first electrode other than a first electrode belonging to a display cell to which the third electrode belongs.

It is preferable that the third and fifth electrodes form a preliminary display gap therebetween.

It is preferable that the third and fifth electrodes are at least partially composed of a material which does not allow a visible light to pass therethrough.

The plasma display panel may further include a light-shielding layer formed at least partially on the first substrate in alignment with the preliminary discharge gap, the light-shielding layer having opaqueness to a visible light.

In another aspect of the present invention, there is provided a method of driving a plasma display panel including (a) a first substrate, (b) a second substrate facing the first substrate, (c) a plurality of first electrodes formed on a surface of the first substrate which surface faces the second electrode, the first electrodes extending in parallel with one another in a first direction, and each having an input terminal through which a pulse is input thereinto, (d) a plurality of second electrodes formed on a surface of the second substrate which surface faces the first electrode, the second electrodes extending in parallel with one another in a second direction perpendicular to the first direction, and each having an input terminal through which a pulse is input thereinto, and (e) a plurality of display cells arranged at intersections of the first electrodes with the second electrodes, wherein a first selection pulse is input into the first electrodes and a second selection pulse is input selectively into one or more of the second electrodes to thereby control whether light is to be emitted in each of the display cells, and at least one of the display cells has a third electrode formed on the first substrate and being electrically connected to a first electrode A other than a first electrode B belonging to a display cell to which the third electrode belongs, the method including the steps of (a) in at least one of the display cells having the third electrode, by the application of the first selection pulse to the first electrode A, generating priming discharge at a third electrode in the display cell, and (b) applying the first selection pulse to the first electrode B subsequently to the step (a).

The method may further include the step of composing the third electrode at least partially of a material which does not allow a visible light to pass therethrough.

There is further provided a method of driving a plasma display panel including (a) a first substrate, (b) a second substrate facing the first substrate, (c) a plurality of first electrodes formed on a surface of the first substrate which surface faces the second electrode, the first electrodes extending in parallel with one another in a first direction, and each having an input terminal through which a pulse is input thereinto, (d) a plurality of second electrodes formed on a surface of the second substrate which surface faces the first electrode, the second electrodes extending in parallel with one another in a second direction perpendicular to the first direction, and each having an input terminal through which a pulse is input thereinto, (e) a plurality of fourth electrodes extending in parallel with the first electrodes with a primary discharge gap being sandwiched therebetween, and (f) a plurality of display cells arranged at intersections of the first and fourth electrodes with the second electrodes, wherein a first selection pulse is input into the first electrodes and a second selection pulse is input selectively into one or more of the second electrodes to thereby control whether light is to be emitted in each of the display cells, and at least one of the display cells has a third electrode formed on the first substrate and being electrically connected to a first electrode A other than a first electrode B belonging to a display cell to which the third electrode belongs, the method including the steps of (a) in at least one of the display cells having the third electrode, by the application of the first selection pulse to the first electrode A, generating priming discharge at a third electrode in the display cell, and (b) applying the first selection pulse to the first electrode B subsequently to the step (a).

The method may further include the step of forming a preliminary discharge gap between the third and fourth electrodes, wherein the priming discharge is generated at the preliminary discharge gap.

The method may further include the steps of keeping a fourth electrode of the display cell at a voltage at which discharge is generated at the preliminary discharge gap, in at least a part of a period in which the first selection pulse is applied to the third electrode of the display cell, and keeping the fourth electrode of the display cell at a voltage at which discharge is not generated at the preliminary discharge gap, in a period in which the first selection pulse is applied to the first electrode of the display cell.

The method may further include the step of dividing the display cells into a plurality of display cell groups such that a display cell including a third cell and a display cell including a first electrode electrically connected to the third electrode do not belong to a common group, and dividing the fourth electrodes into a plurality of electrode groups such that fourth electrodes in each of the display cell groups belong to a common electrode group for controlling a voltage of the fourth electrode in each of the electrode groups.

The method may further include the step of successively applying the first selection pulse a plurality of times to a plurality of the third electrodes belonging to any one of the display cell groups.

The method may further include the step of keeping the fourth electrode of the display cell at a voltage at which discharge is not generated at the preliminary discharge gap, in a period in which the first selection pulse is applied to the first electrode A of the display cell.

It is preferable that a field is divided into a plurality of sub-fields including at least the step of applying the first selection pulse, at least one sub-field among the sub-fields includes the step of carrying out first initialization which step includes the sub-step of carrying out initialization at the primary discharge gap, and at least one sub-field among the sub-fields includes the step of carrying out second initialization which step includes the sub-step of carrying out initialization at the primary discharge gap, but does not include the sub-step of carrying out initialization at the primary discharge gap.

The method may further include the step of composing the third and fourth electrodes at least partially of a material which does not allow a visible light to pass therethrough.

The method may further include the step of forming a light-shielding layer at least partially on the first substrate in alignment with the preliminary discharge gap, the light-shielding layer having opaqueness to a visible light.

It is preferable that a period of time from the generation of the priming discharge in the display cell until the application of the first selection pulse to the first electrode belonging to the display cell is equal to or smaller than 100 microseconds, preferably 20 microseconds.

There is still further provided a method of driving a plasma display panel including (a) a first substrate, (b) a second substrate facing the first substrate, (c) a plurality of first electrodes formed on a surface of the first substrate which surface faces the second electrode, the first electrodes extending in parallel with one another in a first direction, and each having an input terminal through which a pulse is input thereinto, (d) a plurality of second electrodes formed on a surface of the second substrate which surface faces the first electrode, the second electrodes extending in parallel with one another in a second direction perpendicular to the first direction, and each having an input terminal through which a pulse is input thereinto, (e) a plurality of fourth electrodes extending in parallel with the first electrodes with a primary discharge gap being sandwiched therebetween, (f) a plurality of fifth electrodes extending in parallel with the first and fourth electrodes, and (g) a plurality of display cells arranged at intersections of the first and fourth electrodes with the second electrodes, wherein a first selection pulse is input into the first electrodes and a second selection pulse is input selectively into one or more of the second electrodes to thereby control whether light is to be emitted in each of the display cells, and at least one of the display cells has a third electrode formed on the first substrate and being electrically connected to a first electrode A other than a first electrode B belonging to a display cell to which the third electrode belongs, the method including the steps of (a) in at least one of the display cells having the third electrode, by the application of the first selection pulse to the first electrode A, generating priming discharge at a third electrode in the display cell, and (b) applying the first selection pulse to the first electrode B subsequently to the step (a).

The method may further include the step of forming a preliminary discharge gap between the third and fifth electrodes, wherein the priming discharge is generated at the preliminary discharge gap.

It is preferable that a field is divided into a plurality of sub-fields including at least the step of applying the first selection pulse, at least one sub-field among the sub-fields includes the step of carrying out first initialization which step includes the sub-step of carrying out initialization at the primary discharge gap, and at least one sub-field among the sub-fields includes the step of carrying out second initialization which step includes the sub-step of carrying out initialization at the primary discharge gap, but does not include the sub-step of carrying out initialization at the primary discharge gap.

The method may further include the step of composing the third and fifth electrodes at least partially of a material which does not allow a visible light to pass therethrough.

The method may further include the step of forming a light-shielding layer at least partially on the first substrate in alignment with the preliminary discharge gap, the light-shielding layer having opaqueness to a visible light.

It is preferable that a period of time from the generation of the priming discharge in the display cell until the application of the first selection pulse to the first electrode belonging to the display cell is equal to or smaller than 100 microseconds, preferably 20 microseconds.

The advantages obtained by the aforementioned present invention will be described hereinbelow.

In accordance with the present invention, it is possible to shorten a period of time necessary for data-writing in a line, and hence, even if a number of display lines or a number of sub-fields is increased, it would be possible to ensure sufficient period of time for generating sustaining discharges for displaying image.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

[First Embodiment]

Figure 4:
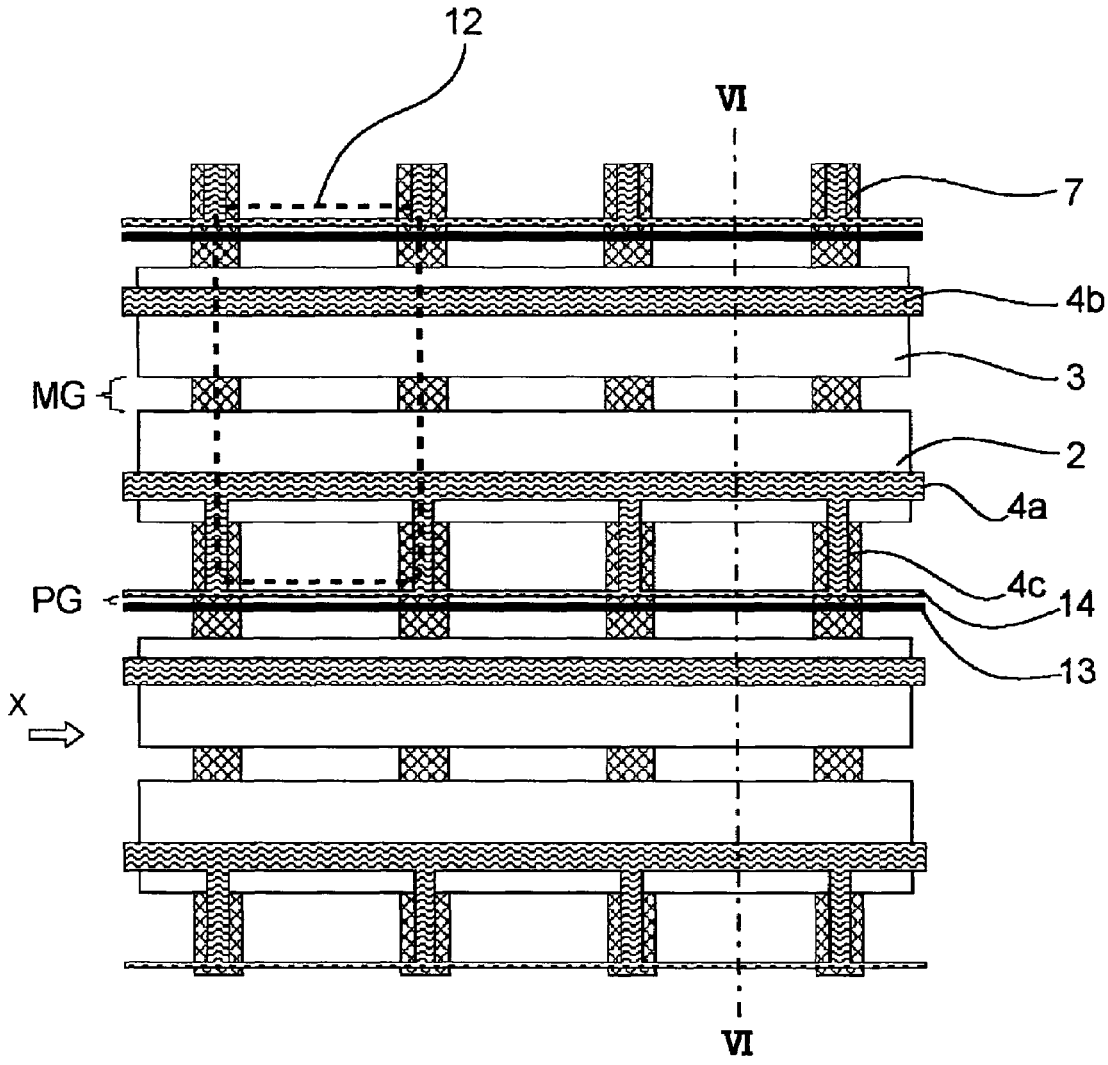
FIG. 4 is a plan view of a plasma display panel in accordance with the first embodiment of the present invention.

FIG. 4 is a plan view of a plasma display panel in accordance with the first embodiment of the present invention.

Figure 1:
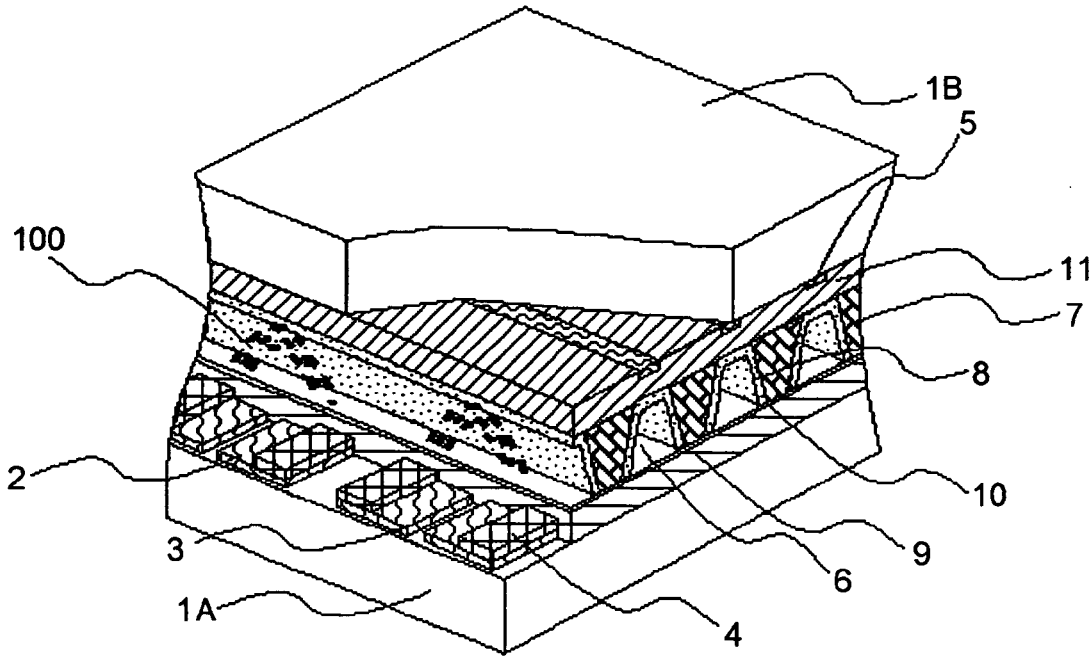
FIG.1 PRIOR ART
FIG. 1 is a perspective broken view of a conventional plasma display panel.
Figure 2:
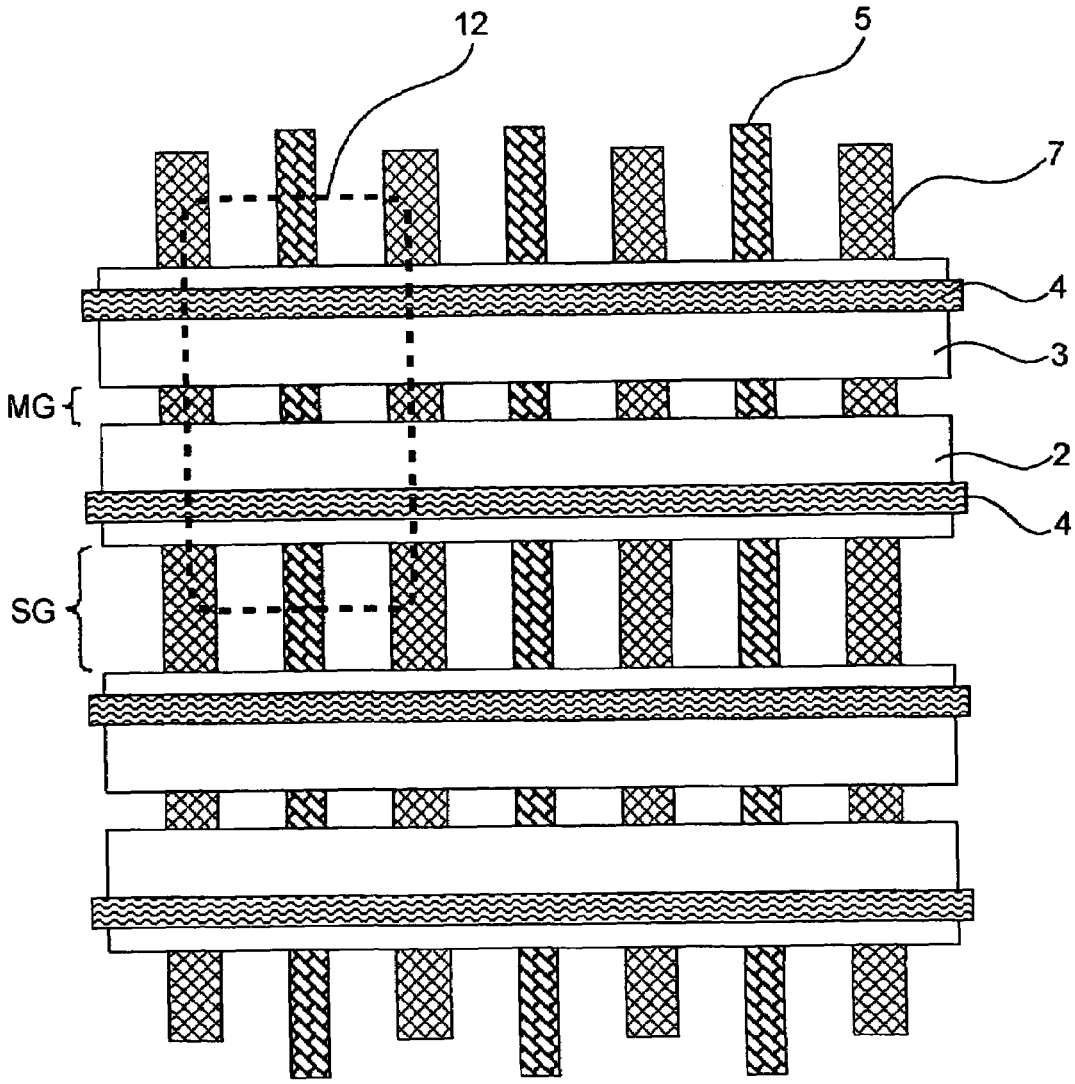
FIG.2 PRIOR ART
FIG. 2 is a plan view of the plasma display panel illustrated in FIG. 1, as viewed from a viewer.
Figure 3:
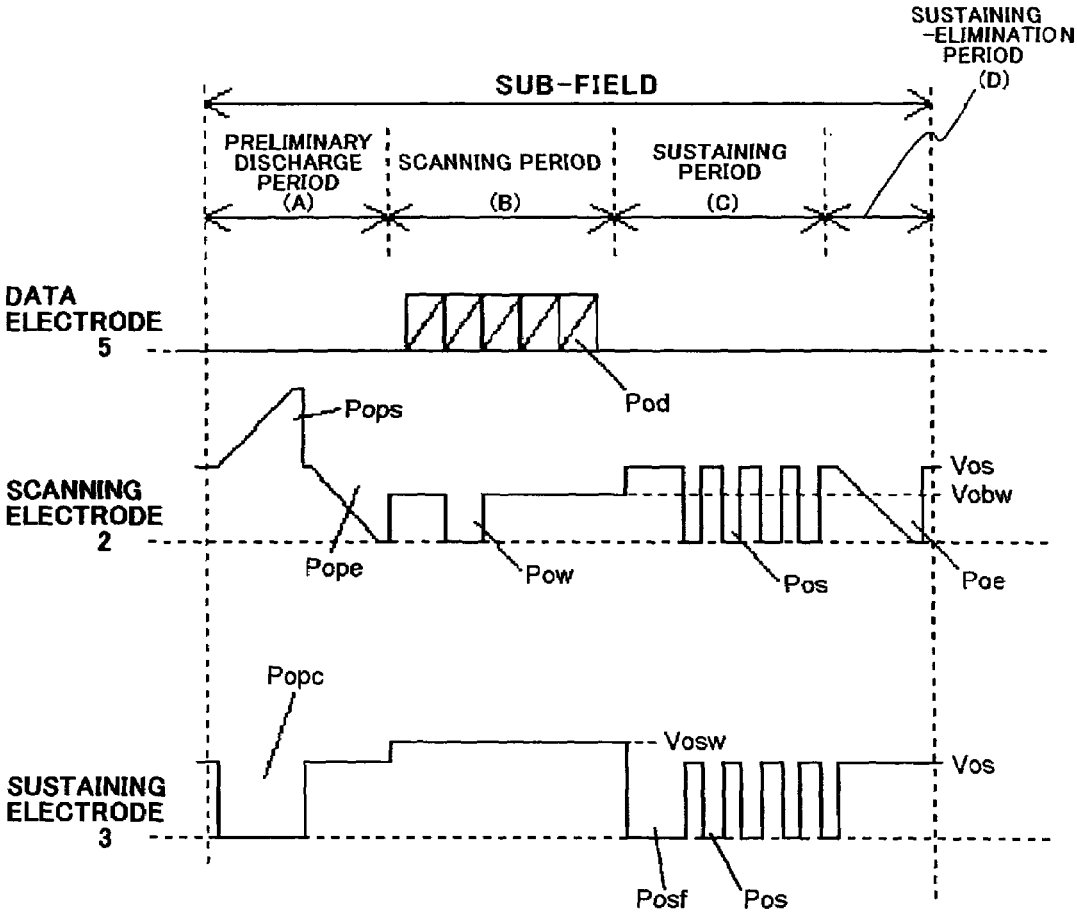
FIG.3 PRIOR ART
FIG. 3 is a timing chart showing waveforms of voltage pulses to be applied to electrodes in the conventional method of driving a plasma display panel illustrated in FIG. 1.

A plasma display panel in accordance with the first embodiment is structurally different from the conventional plasma display panel illustrated in FIG. 2 only in electrode-arrangement on the front substrate 1A. A plasma display panel in accordance with the first embodiment is structurally identical with the conventional plasma display panel illustrated in FIG. 2 with respect to the rear substrate 1B.

On the front substrate 1A are formed the transparent scanning electrodes 2 and the transparent sustaining electrodes 3 with the primary discharge gap MG being sandwiched therebetween. The metal trace electrodes 4*a* and 4*b* are formed on the scanning and sustaining electrodes 2 and 3, respectively, to reduce a resistance of the electrodes 2 and 3.

In parallel with the sustaining electrode 3 extends a priming electrode 13 at an opposite side about the primary discharge gap MG.

Between the priming electrode 13 and the scanning electrode 2 extend a preliminary scanning electrode 14 in parallel with the scanning and sustaining electrodes 2 and 3 and the priming electrode 13. The preliminary scanning electrode 14 and the priming electrode 13 form a priming gap PG therebetween. The preliminary scanning electrode 14 is electrically connected to the trace electrode 4*a* in an adjacent display cell through a cross-link 4*c* extending in parallel with and under the partition wall 7 between the scanning electrode 2 and the preliminary scanning electrode 14.

In the first embodiment, the priming electrode 13 and the preliminary scanning electrode 14 are composed of metal, and are formed concurrently with the trace electrodes 4*a* and 4*b*.

In FIG. 4, the data electrodes 5 are omitted for simplification.

The electrodes 2, 3, 13 and 14 are electrically connected to driver circuits located outside the plasma display panel.

Specifically, the scanning electrodes 2 are electrically connected in each of display lines to scanning drivers (not illustrated), for instance, through a lead wire. All of the sustaining electrodes 3 are electrically connected to one another, and further to a sustaining driver (not illustrated). All of the priming electrodes 13 are electrically connected to one another, and further to a priming driver (not illustrated). The preliminary scanning electrodes 14 are not electrically connected to an external driver circuit, because they are individually electrically connected to the scanning electrodes 2 through the cross-link 4*c* and the trace electrode 4*a*.

Hereinbelow is explained a method of driving a plasma display panel.

Figure 5:
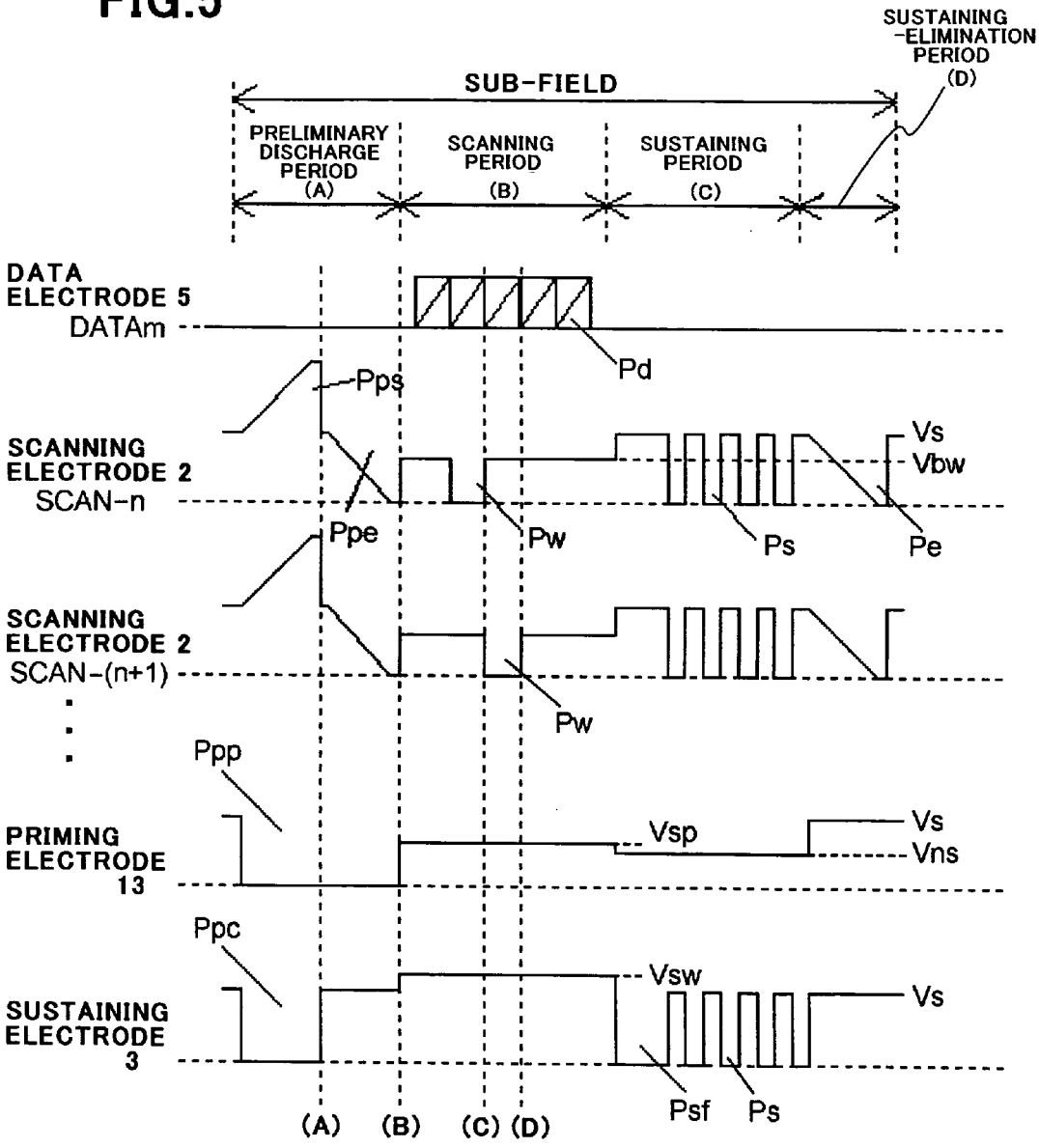
FIG. 5 is a timing chart showing waveforms of voltage pulses to be applied to electrodes in a method of driving the plasma display panel in accordance with the first embodiment.

FIG. 5 is a timing chart showing waveforms of voltage pulses to be applied to the electrodes in a method of driving the plasma display panel.

FIG. 5 illustrates a sub-field comprised of a preliminary discharge period (A), a scanning period (B), a sustaining period (C) and a sustaining-elimination period (D). The preliminary discharge period (A) is a period in which display cells are reset for causing discharges to be readily generated in the subsequent scanning period (B), the scanning period (B) is a period in which it is selected which display cell or cells is(are) to be turned on or off, the sustaining period (C) is a period in which discharges are generated in all of the selected display cells, and the sustaining-elimination period (D) is a period in which the discharges having been generated in the sustaining period (C) are terminated. Such a fundamental cycle is called a sub-field.

The sustaining electrodes 3 are driven in accordance with a common pulse, and similarly, the priming electrodes 13 are driven in accordance with a common pulse. The scanning electrodes 2 are driven separately line by line. Hence, FIG. 5 illustrates a waveform of a pulse for driving the scanning electrodes SCAN-n in a n-th line, and a waveform of a pulse for driving the scanning electrodes SCAN-(n+1) in a (n+1)-th line.

A pulse to be applied to the preliminary scanning electrode 14 in a (n+1)-th line has the same waveform as that of a pulse to be applied to the scanning electrode 2 in an n-th line.

Among the data electrodes 5, a waveform of a pulse to be applied to the data electrode 5 at m-th row is illustrated in FIG. 5.

In the first embodiment, reference voltages of the surface electrodes comprised of the scanning and sustaining electrodes 2 and 3 and the priming electrodes 13 are set equal to a sustaining voltage Vs to keep discharges generated in the sustaining period (C). Accordingly, with respect to the scanning and sustaining electrodes 2 and 3 and the priming electrodes 13, a voltage higher than the sustaining voltage Vs is a positive voltage, and a voltage lower than the sustaining voltage Vs is a negative voltage. The sustaining voltage Vs is set equal to about 170V, for instance. With respect to the data electrodes 5, a reference voltage is set equal to zero (0) volt.

Figure 6:
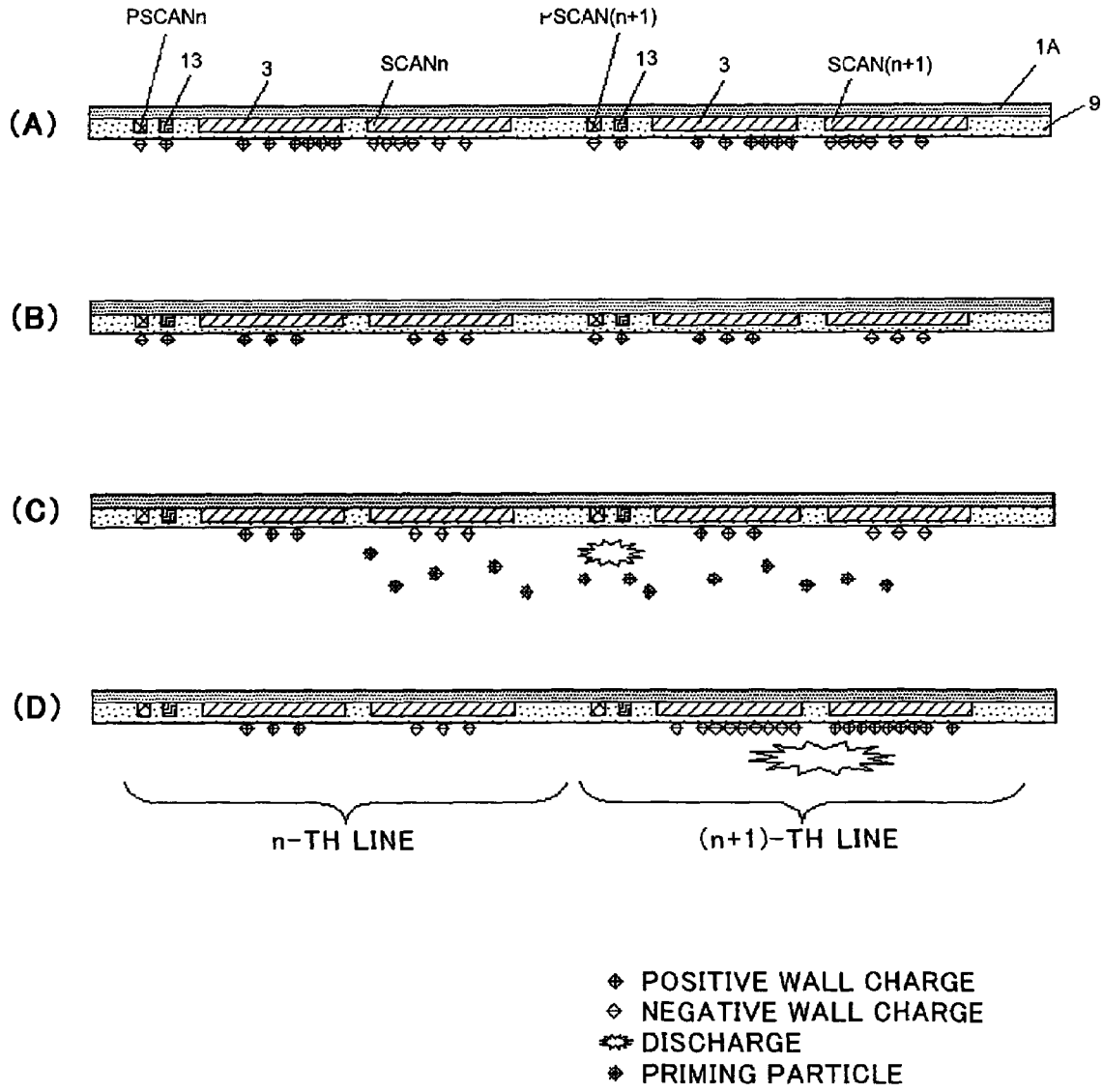
FIG. 6 is a cross-sectional view showing wall charges in a display cell in the plasma display panel in accordance with the first embodiment.

FIG. 6 is a cross-sectional view taken along the line VI—VI in FIG. 4 as viewed from "X". FIG. 6(A), (B), (C) and (D) indicate discharges and wall charges observed at the time A, B, C and D in FIG. 5, respectively.

In FIG. 6, the preliminary scanning electrode 14 in an n-th line is indicates as "PSCAN n". In FIG. 6, the trace electrodes 4 and the rear substrate 1B are omitted for simplification.

In the preliminary discharge period (A), a positive serrate preliminary discharge pulse Pps is applied to both of the scanning electrodes 2 and the preliminary scanning electrodes 14, and concurrently, a negative rectangular preliminary discharge pulse Ppc is applied to the sustaining electrodes 3 and a negative rectangular preliminary discharge pulse Ppp is applied to the priming electrodes 13.

Both of the preliminary discharge pulses Ppc and Ppp have a voltage of zero (0).

Each of the preliminary discharge pulses Pps, Ppc and Ppp is designed to have a wave-height greater than a threshold voltage at which discharge starts being generated between the scanning and sustaining electrodes 2 and 3 and further than a threshold voltage at which discharge starts being generated between the preliminary discharge electrode 14 and the priming electrode 13. Hence, weak discharge is generated between the scanning and sustaining electrodes 2 and 3 when the preliminary discharge pulses Pps and Ppc are applied to the scanning and sustaining electrodes 2 and 3, and a voltage of the serrate preliminary discharge pulse Pps raises, thereby a voltage between the scanning and sustaining electrodes 2 and 3 exceeds the above-mentioned threshold voltage.

Furthermore, weak discharge is generated also between the scanning and priming electrodes 2 and 13 when the preliminary discharge pulses Pps and Ppp are applied to the scanning and priming electrodes 2 and 13, and a voltage of the serrate preliminary discharge pulse Pps raises, thereby a voltage between the scanning and priming electrodes 2 and 13 exceeds the above-mentioned threshold voltage.

As a result, as illustrated in FIG. 6-(A), negative wall charges are accumulated above the scanning electrodes 2 and the preliminary scanning electrodes 14, and positive wall charges are accumulated above the sustaining electrodes 3 and the priming electrodes 13.

Following the preliminary discharge pulse Pps, a negative serrate preliminary discharge-eliminating pulse Ppe is applied to the scanning electrodes 2 and the preliminary scanning electrodes 14. The sustaining electrodes 3 are kept at the sustaining voltage Vs.

The preliminary discharge pulse Ppp is kept applied to the priming electrodes 13 to thereby keep the priming electrodes 13 at 0V.

By applying the negative serrate preliminary discharge-eliminating pulse Ppe to the scanning electrodes 2 and the preliminary scanning electrodes 14, wall charges having been accumulated above the scanning and sustaining electrodes 2 and 3 are eliminated. In contrast, since there is not generated discharge between the priming electrode 13 and the preliminary scanning electrodes 14, as illustrated in FIG. 6-(B), wall charges having been accumulated above the priming electrodes 13 and the preliminary scanning electrodes 14 remain unchanged.

Herein, the term "eliminate" should not be limited to elimination of all of wall charges, but should be interpreted as including reduction in wall charges for smoothly generating discharges in the scanning period (B) and the sustaining period (C).

In the scanning period (B), all of the scanning electrodes 2 are kept at a base voltage Vbw, and then, a negative scanning pulse Pw is applied to the scanning electrodes 2 one by one, and concurrently, a data pulse Pd is applied to the data electrodes 5 in accordance with data to be displayed. The sustaining electrodes 3 are kept at a positive voltage Vsw, and the priming electrodes 13 are kept at a negative voltage Vsp.

Ultimate voltages of the scanning pulse Pw and the data pulse Pd are determined such that a voltage across the scanning and data electrodes 2 and 5 does not exceed a threshold voltage at which discharge is generated between the scanning and data electrodes 2 and 5, if only one of the scanning pulse Pw and the data pulse Pd is applied to the scanning or data electrodes 2 or 5, but exceeds the threshold voltage, if both of the scanning pulse Pw and the data pulse Pd are applied to the scanning and data electrodes 2 and 5, respectively.

The voltage Vsw at which the sustaining electrodes 3 are kept in the scanning period (B) is determined such that a voltage across the scanning and sustaining electrodes 2 and 3 does not exceed a threshold voltage at which discharge is generated between the scanning and sustaining electrodes 2 and 3, even if the voltage Vsw is added to the scanning pulse Pw.

The priming electrodes 13 have such a voltage Vsp that a voltage across the priming electrodes 13 and the preliminary scanning electrodes 14 does not exceed a threshold voltage at which there is generated discharge between the priming electrodes 13 and the preliminary scanning electrodes 14, and hence, there is not generated discharge between the priming electrodes 13 and the preliminary scanning electrodes 14, if the preliminary scanning electrodes 14 (and hence, the scanning electrodes 2) are kept at the base voltage Vbw, but exceeds the above-mentioned threshold voltage, and hence, there is generated discharge between the priming electrodes 13 and the preliminary scanning electrodes 14, if the scanning pulse Pw is applied to the preliminary scanning electrodes 14 (and hence, the scanning electrodes 2).

In the first embodiment, the voltage Vsp is set equal to the base voltage Vbw.

Herein, each of a voltage across the facing electrodes such as the scanning electrodes 2 and the data electrodes 5 and a voltage across the surface electrodes such as the scanning electrodes 2 and the sustaining electrodes 3 is defined as a sum of an externally applied voltage and a voltage caused by wall charges accumulated in a display cell.

Accordingly, cross-discharge is generated between the scanning and data electrodes 2 and 5 only in a display cell in which the scanning pulse Pw is applied to the scanning electrodes 2 and the data pulse Pd is applied to the data electrodes 5.

When cross-discharge is generated between the scanning and data electrodes 2 and 5, since a voltage caused by the scanning pulse Pw and the voltage Vsw is applied across the scanning and sustaining electrodes 2 and 3, there is generated discharge also between the scanning and sustaining electrodes 2 and 3 with the cross-discharge acting as a trigger. The thus generated discharge is data-writing discharge.

As a result, positive wall charges are accumulated above the scanning electrode 2, and negative wall charges are accumulated above the sustaining electrodes 3 in a selected display cell.

Hereinbelow is explained in detail an operation in the scanning period (B).

When the scanning pulse Pw is applied to the n-th line scanning electrode SCANn and the data pulse Pd is applied to the data electrode 5, there is generated data-writing discharge in display cells belonging to the n-th line.

In the (n+1)-th line, a preliminary scanning pulse substantially identical with the n-th line scanning pulse Pw is applied to the preliminary scanning electrodes 14 PSCAN (n+1). Thus, there is generated priming discharge in the (n+1)-th line between the preliminary scanning electrodes 14 and the priming electrode 13. FIG. 6-(C) shows priming discharge generated between the preliminary scanning electrodes 14 and the priming electrode 13 in the case that the data pulse Pd is not applied to the data electrodes 5.

The priming discharge is not so intensive, because the griming electrodes 13 and the preliminary scanning electrodes 14 do not have a large area.

In addition, since the primary discharge gaps MG in the n-th and (n+1)-th lines are far away from the priming discharge, there is not generated erroneous discharge between the scanning and sustaining electrodes 2 and 3.

After the application of the scanning pulse Pw to the n-th line scanning electrodes SCANn has terminated, the scanning pulse Pw is applied to the (n+1)-th line scanning electrode SCAN (n+1).

Concurrently, the data pulse Pd is applied to the data electrodes 5 in a selected display cell. Then, there is generated discharge between the scanning electrode 2 and the data electrode 5, and the thus generated discharge triggers generation of discharge between the scanning and sustaining electrodes 2 and 3. As a result, positive wall charges are accumulated above the scanning electrode 2, and negative wall charges are accumulated above the sustaining electrode 3. FIG. 6D illustrates discharge generated between the scanning and sustaining electrodes 2 and 3 when the data pulse Pd is applied to the data electrodes 5.

In a (n+2)-th line, the preliminary scanning pulse applied to the preliminary scanning electrode PSCAN (n+2) causes generation of priming discharge between the preliminary scanning electrodes 14 and the priming electrode 13.

Then, in the sustaining period (C), all of the scanning electrodes 2 are kept at the sustaining voltage Vs, and the first sustaining pulse Psf is applied to the sustaining electrode 3.

The sustaining voltage Vs is determined to be such a voltage that if a voltage caused by wall charges accumulated above the surface electrodes by data-writing discharge in the scanning period (B) is added to the sustaining voltage Vs, discharge will be generated, and if not, a voltage across the surface electrodes will not exceed a threshold voltage, and hence, discharge is generated between the surface electrodes.

Accordingly, sustaining voltage is generated only in a display cell in which there has been generated data-writing discharge in the scanning period (B), and hence, wall charges have been accumulated on above the surface electrodes.

Then, sustaining pulses Ps having a wave-height equal to the sustaining voltage Vs and having phases inverted to each other are applied to the scanning and sustaining electrodes 2 and 3. As a result, there is generated sustaining voltage only in a display cell in which discharge has been generated by the first sustaining pulse Psf.

The priming electrode 13 is kept at a voltage of Vs/2 which is an intermediate voltage of the sustaining pulse Ps. Thus, it is possible to prevent generation of unnecessary discharge between the priming electrode 13 and the sustaining electrode 3 or between the priming electrode 13 and the preliminary scanning electrodes 14 in a display cell in which sustaining discharge is not generated.

In the subsequent sustaining period (D), the sustaining electrode 3 and the priming electrode 13 are kept at the sustaining voltage Vs, and a negative serrate sustaining-elimination pulse Pe is applied to the scanning electrode 2. As a result, wall charges having been accumulated above the surface electrodes 2 and 3 sandwiching the primary discharge gap MG therebetween are eliminated, and hence, the plasma display panel is returned back to its initial condition, that is, a condition observed prior to the application of the preliminary discharge pulses Pps and Ppc to the scanning and sustaining electrodes 2 and 3 in the preliminary discharge period (A).

Herein, the term "eliminate" should not be limited to elimination of all of wall charges, but should be interpreted as including reduction in wall charges for smoothly generating discharges in the subsequent periods.

Wall charges are reset above the surface electrodes 2 and 3 sandwiching the primary discharge gap MG therebetween in a preliminary discharge period (A) in the next sub-field regardless of wall charge conditions.

Hereinbelow is explained the reason why the scanning period (B) can be shortened by the plasma display panel in accordance with the first embodiment.

A pulse width of the scanning pulse Pw, that is, a period of time necessary for writing data in each of display lines is dependent on a first period of time (hereinbelow, referred to as "accumulation time") necessary for discharge to grow and for wall charges to be sufficiently accumulated, and a second period of time (hereinbelow, referred to as "static delay time") from application of a pulse to an electrode until generation of discharge.

The accumulation time slightly varies due to an externally applied voltage and/or internal condition of a display cell, but does not much vary. Hence, a minimum pulse width is dependent mainly on the accumulation time.

In contrast, the static delay time is dependent on a ratio at which discharge is generated (hereinbelow, referred to as "discharge generation ratio"), and much varies in accordance with internal condition of a display cell.

Assuming that the static delay time is defined as a period of time necessary for generation of discharge at a certain ratio, if a discharge generation ratio is high, the static delay time is short. Though the discharge generation ratio varies due to various conditions, the discharge generation ratio is much influenced particularly by a density of electrons and/or ions existing in discharge gas or priming particles such as excited atomics or molecules.

However, a density of priming particles is rapidly reduced with the lapse of time due to absorption into a wall and/or collision of priming particles with one another. Accordingly, a discharge generation ratio of a display line in which data writing is carried out temporally remote from the preliminary discharge period (A) is unavoidably small, and hence, it was impossible to shorten a pulse width in the conventional method of driving a plasma display panel.

In contrast, in the plasma display panel in accordance with the first embodiment, since discharge is generated between the priming electrode 13 and the preliminary scanning electrodes 14 immediately before the application of the scanning pulse Pw to the scanning electrode 2, it would be possible to carry out data-writing at a very high discharge generation ratio.

Hence, it is possible to shorten a pulse width of the scanning pulse Pw necessary for data-writing. Accordingly, even if a number of display lines or a number of sub-fields is increased, it would be possible to lower an occupation rate of the scanning period (B) in one field, ensuring displaying images at a high luminance.

In the plasma display panel in accordance with the first embodiment, preliminary discharge and priming discharge are generated between the priming electrode 13 and the preliminary scanning electrodes 14 in each of sub-fields in all of display cells regardless of whether display cells are selected or not. Those discharges increase a luminance in black-display, causing reduction in contrast in darkness.

In actual, contrast in darkness is not so reduced, because the priming electrode 13 and the preliminary scanning electrodes 14 have a small electrode-area, and hence, resultant discharge is so weak, and discharge area except the priming gap PG is shielded from light by the electrodes.

However, the plasma display panel in accordance with the first embodiment may be modified, because contrast in darkness is considered important in some cases.

Figure 7:
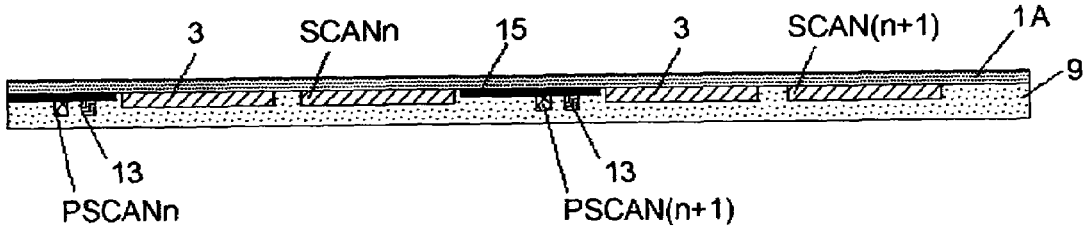
FIG. 7 is a cross-sectional view of a variance of the plasma display panel in accordance with the first embodiment.

An example of a variance of the plasma display panel in accordance with the first embodiment is illustrated in FIG. 7. FIG. 7 is a cross-sectional view of a front substrate in a variance of the plasma display panel in accordance with the first embodiment.

The variance illustrated in FIG. 7 is designed to additionally include a light-shielding layer 15 between adjacent display cells 12 so as to cover the priming electrode 13 and the preliminary scanning electrodes 14 therewith, in comparison with the plasma display panel in accordance with the first embodiment.

In the variance, light emission caused by priming discharge is almost completely shielded by the light-shielding layer 15, ensuring that contrast is prevented from being deteriorated.

However, since a part of light emission caused by sustaining discharge is also shielded, there is caused a problem that a luminance is slightly reduced.

A plasma display panel in accordance with the second embodiment explained hereinbelow solve the problem.

[Second Embodiment]

Figure 8:
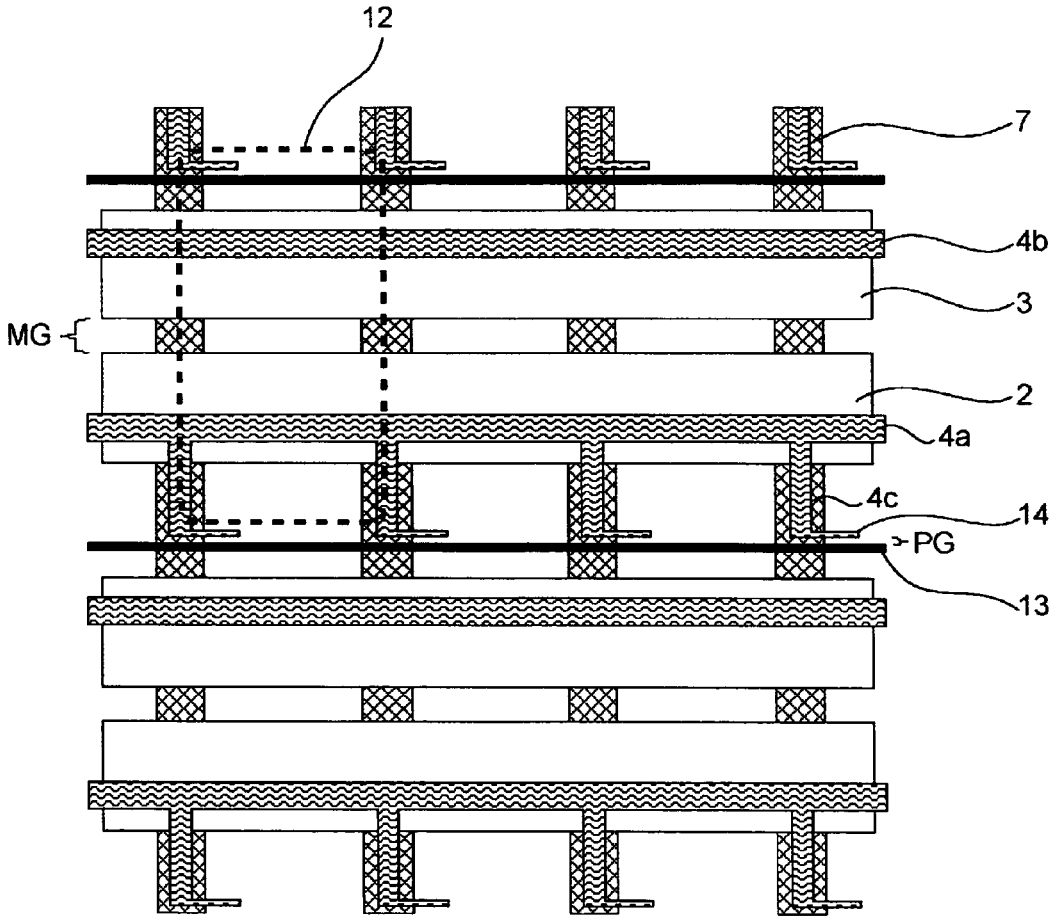
FIG. 8 is a plan view of a plasma display panel in accordance with the second embodiment of the present invention.

FIG. 8 is a plan view of a plasma display panel in accordance with the second embodiment of the present invention.

The plasma display panel in accordance with the second embodiment is structurally identical with the plasma display panel in accordance with the first embodiment except that the preliminary scanning electrode 14 is designed not to extend beyond the display cell 12. Specifically, the preliminary scanning electrode 14 in the second embodiment is formed individually below each of the partition wall 7. Unlike the preliminary scanning electrode 14 in the first embodiment, the preliminary scanning electrode 14 in the second embodiment is not continuous with adjacent preliminary scanning electrodes 14.

Hereinbelow is explained a method of driving the plasma display panel in accordance with the second embodiment.

Figure 9:
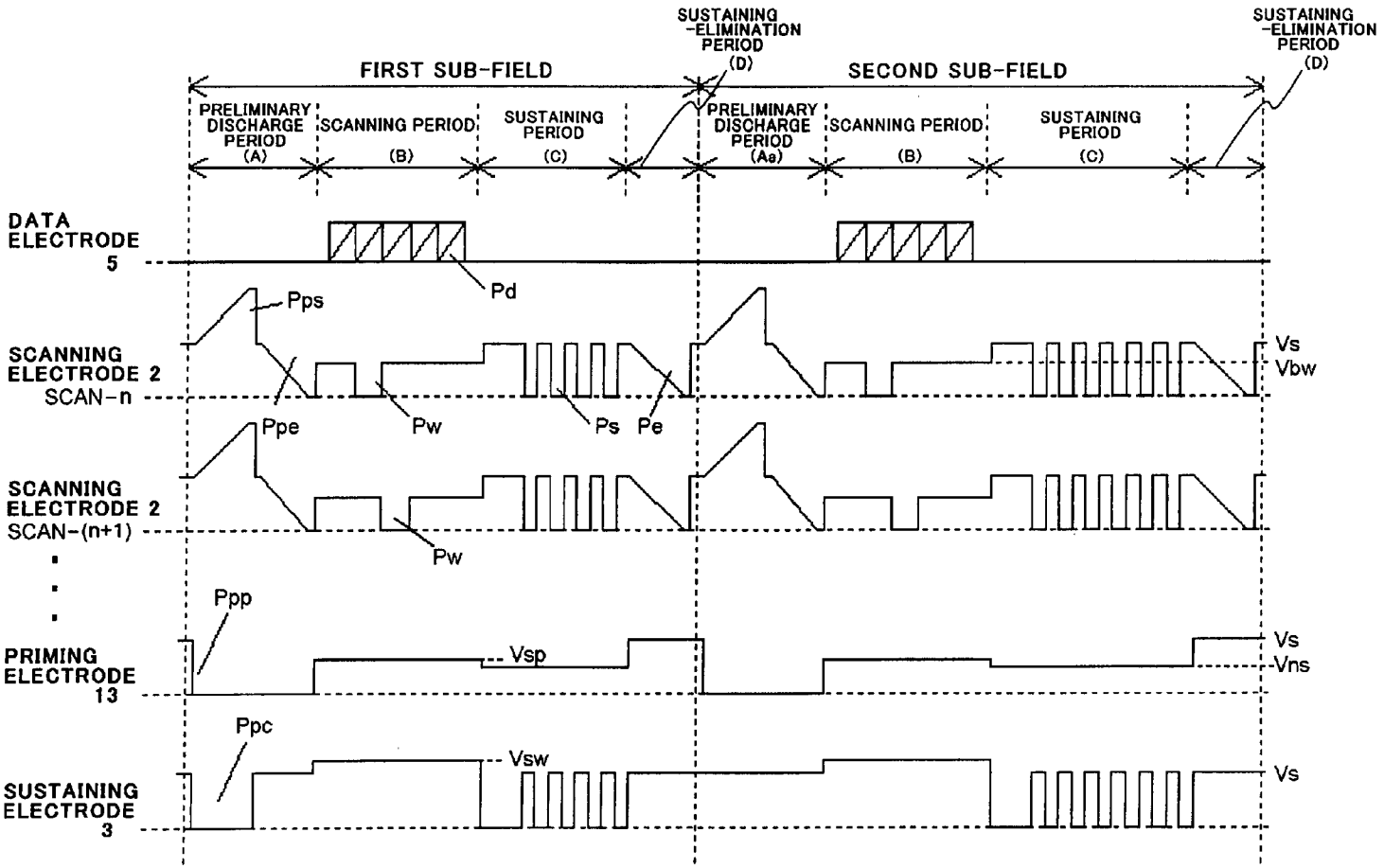
FIG. 9 is a timing chart showing waveforms of voltage pulses to be applied to electrodes in a method of driving the plasma display panel in accordance with the second embodiment.

FIG. 9 is a timing chart showing waveforms of voltage pulses to be applied to electrodes in the method. FIG. 9 shows successive two sub-fields, namely, a first sub-field and a second sub-field.

Waveforms of voltage pulses to be applied to electrodes in the first sub-field are identical with the waveforms in the first embodiment.

The priming gap PG formed between the preliminary scanning electrode 14 and the priming electrode 13 in the second embodiment is quite smaller than the same in the first embodiment, and the preliminary scanning electrode 14 in the second embodiment has a smaller area than an area of the preliminary scanning electrode 14 in the first embodiment.

Hence, it is possible to lower an increase in dark luminance caused by preliminary discharge and priming discharge generated between the preliminary scanning electrode 14 and the priming electrode 13.

Hereinbelow is explained the second sub-field.

A preliminary discharge period Aa in the second sub-field is different from the preliminary discharge period A in the first sub-field only in a waveform of a pulse to be applied to the sustaining electrodes 3. Specifically, the sustaining electrode 3 is kept at the sustaining voltage Vs in the preliminary discharge period Aa. Unlike the first sub-field, the preliminary discharge pulse Ppc is not applied to the sustaining electrode 3 in the second sub-field. Accordingly, there is not generated discharge between the scanning and sustaining electrodes 2 and 3.

Even if sustaining discharge is generated in the first sub-field, data-writing operation to be carried out in the subsequent scanning period (B) is not much influenced by the sustaining discharge, because wall charges have been already re-arranged between the scanning and sustaining electrodes 2 and 3 in the sustain-elimination period (D) in the first sub-field.

There is generated preliminary discharge between the priming electrode 13 and the preliminary scanning electrode 14, similarly to the first sub-field. Hence, there is generated priming discharge in the scanning period (B), similarly to the first sub-field, ensuring a high discharge generation ratio and a shortened pulse width of the scanning pulse Pw.

Accordingly, even if a number of display lines or a number of sub-fields is increased, it would be possible to accomplish a temporally small ratio of the scanning period (B) in one field, ensuring that images can be displayed at a high gray scale.

In addition, there is not generated preliminary discharge in the second sub-field between the scanning and sustaining electrodes 2 and 3 both having a large area. Hence, even if light-emission is generated due to generation of discharge between the priming electrode 13 and the preliminary scanning electrode 14, it would be possible to lower a luminance in dark-display in comparison with the conventional methods. Accordingly, it would be possible to lower a luminance in dark-display and raise a contrast in darkness in comparison with the conventional methods by arranging one or more sub-field in one field which sub-field has the preliminary discharge area A in which preliminary discharge is generated in the discharge gap MG, and designing the rest of sub-fields to include the preliminary discharge area Aa in which preliminary discharge is generated only in the priming gap PG.

[Third Embodiment]

Figure 10:
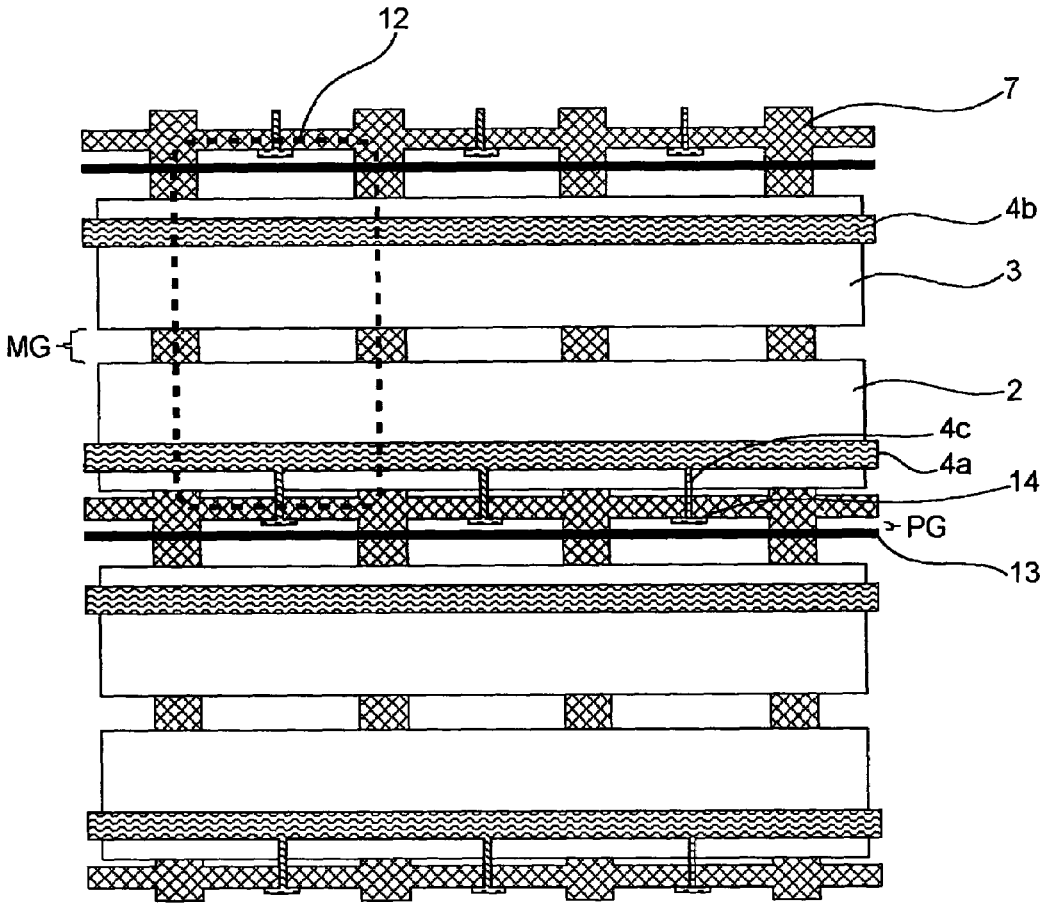
FIG. 10 is a plan view of a plasma display panel in accordance with the third embodiment of the present invention.

FIG. 10 is a plan view of a plasma display panel in accordance with the third embodiment of the present invention.

The plasma display panel in accordance with the third embodiment is structurally identical with the plasma display panels in accordance with the first and second embodiments except that the partition walls 7 are designed to extend further in a horizontal direction between display lines, that is, in parallel with the scanning and sustaining electrodes 2 and 3. That is, the partition walls 7 in the third embodiment are in the form of a grid.

The preliminary scanning electrode 14 is electrically connected to the scanning electrode 2 in an adjacent display cell 12 through the cross-link 4*c* extending across the horizontally extending partition walls 7.

The plasma display panel in accordance with the third embodiment is driven in accordance with the method having been explained in the first and second embodiments. Similarly to the first and second embodiments, it is possible to accomplish a temporally small ratio of the scanning period (B) in one field.

In addition, the horizontally extending partition walls 7 make it possible to suppress discharge interference in vertically adjacent display cells, ensuring that the scanning and sustaining electrodes 2 and 3 can have a larger area than an area of the scanning and sustaining electrodes 2 and 3 in the first embodiment, and hence, images can be displayed at a higher luminance.

[Fourth Embodiment]

Figure 11:
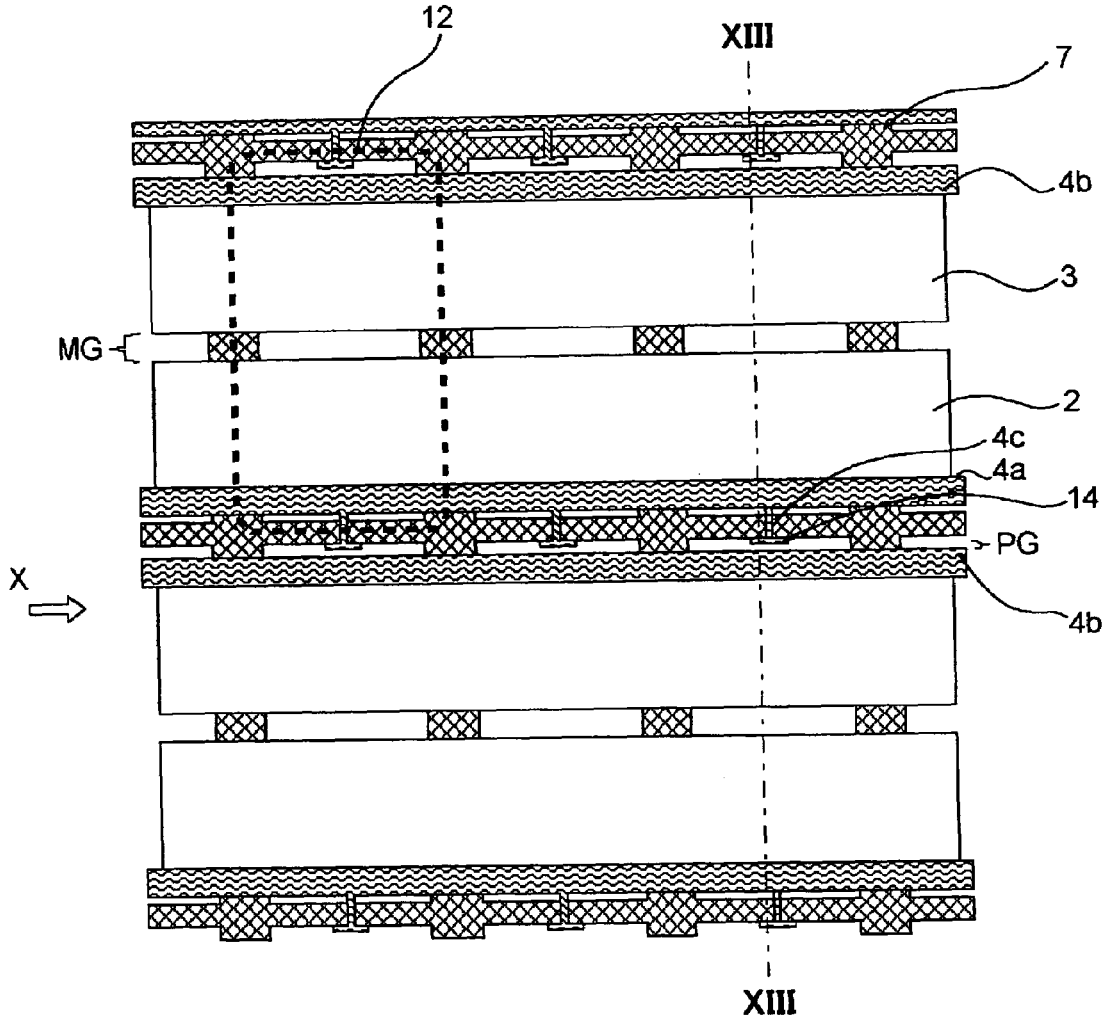
FIG. 11 is a plan view of a plasma display panel in accordance with the fourth embodiment of the present invention.

FIG. 11 is a plan view of a plasma display panel in accordance with the fourth embodiment of the present invention.

In the plasma display panel in accordance with the fourth embodiment, the partition wall 7 is designed to extend horizontally and vertically such that a plurality of display cells 12 is horizontally and vertically arranged. That is, the partition wall 7 is in the form of a grid.

In each of the display cells 12, a pair of the scanning and sustaining electrodes 2 and 3 is arranged with the primary discharge gap MG being sandwiched therebetween.

The preliminary scanning electrode 14 extends in parallel with the scanning and sustaining electrodes 2 and 3 between the sustaining electrode 3 and the scanning electrode 2 belonging to an adjacent display cell with the priming gap PG being sandwiched between the preliminary scanning electrode 14 and the sustaining electrode 3. The preliminary scanning electrode 14 is electrically connected to the scanning electrode 2 in an adjacent display cell 12 through a cross-link 4*c* extending across the horizontally extending partition wall 7 between the scanning electrode 2 and the preliminary scanning electrode 14.

Unlike the above-mentioned first to third embodiments, the plasma display panel in accordance with the fourth embodiment is designed not to include the priming electrode 13.

Hereinbelow is explained a method of driving the plasma display panel in accordance with the fourth embodiment.

Figure 12:
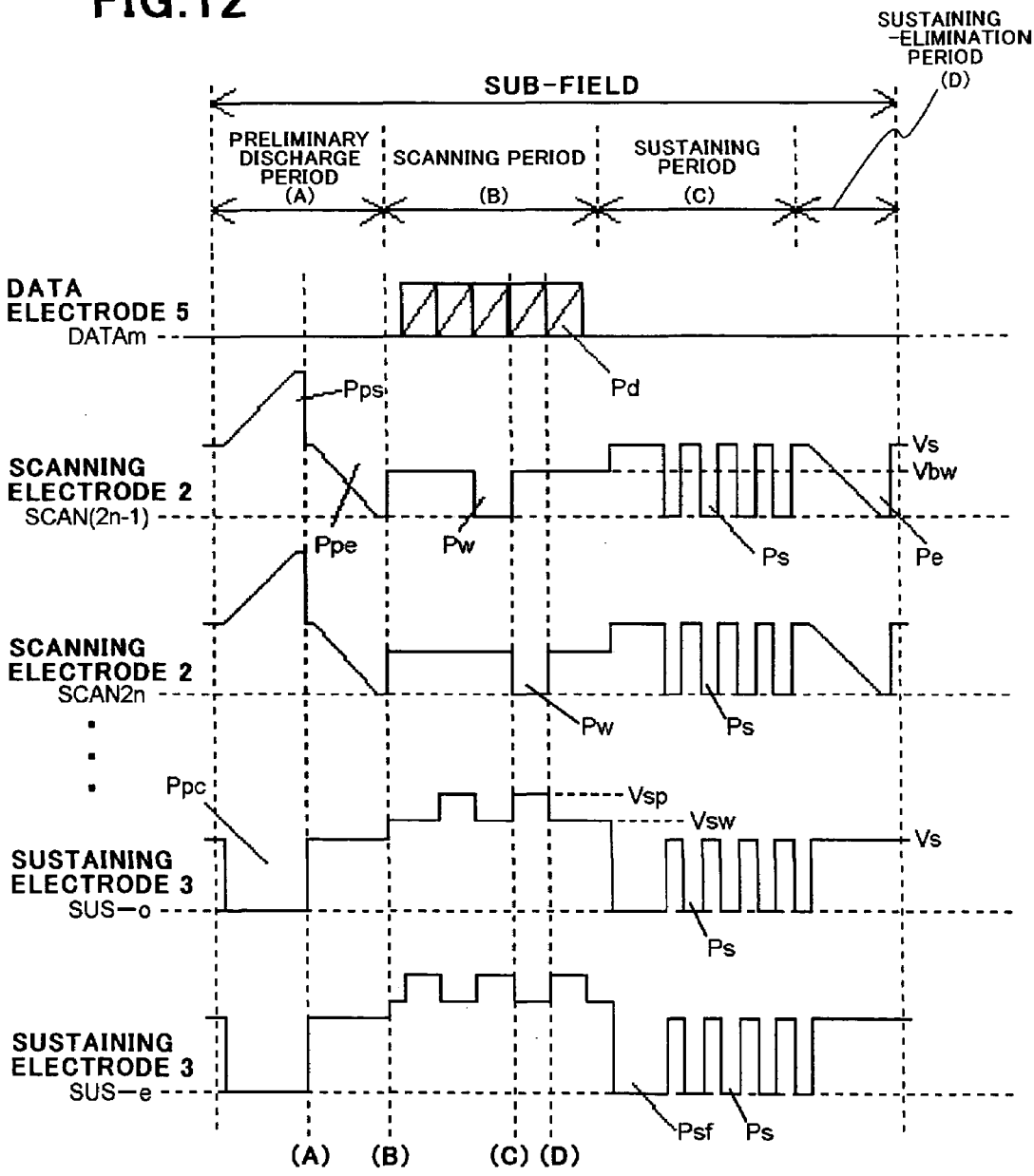
FIG. 12 is a timing chart showing waveforms of voltage pulses to be applied to electrodes in a method of driving the plasma display panel in accordance with the fourth embodiment.

FIG. 12 is a timing chart showing waveforms of voltage pulses to be applied to electrodes in the method.

FIG. 12 illustrates a sub-field comprised of the preliminary discharge period (A), the scanning period (B), the sustaining period (C) and the sustaining-elimination period (D).

The sustaining electrodes 3 is grouped into sustaining electrodes SUS-o belonging to K-th display lines wherein K is an odd number and sustaining electrodes SUS-e belonging to L-th display lines wherein L is an even number. The sustaining electrodes SUS-o and the sustaining electrodes SUS-e are driven separately from each other.

Since the scanning electrodes SCAN are driven individually for each of lines, FIG. 12 illustrates a waveform of a pulse to be applied to scanning electrodes SCAN (2n−1) in the (2n−1)-th line belonging to the K-th display line, and a waveform of a pulse to be applied to scanning electrodes SCAN 2n in the 2n-th line belonging to the L-th display line.

A waveform of a pulse to be applied to the preliminary scanning electrode 14 in the 2n-th line is identical with a waveform of a pulse to be applied to the scanning electrode 2 in the (2n−1)-th line.

A waveform of a pulse to be applied to a data electrode DATAm in a m-th row is illustrated in FIG. 12.

In the fourth embodiment, a reference voltage of the surface electrodes comprised of the scanning and sustaining electrodes 2 and 3 is set equal to a sustaining voltage Vs to keep discharges generated in the sustaining period (C). Accordingly, with respect to the scanning and sustaining electrodes 2 and 3, a voltage higher than the sustaining voltage Vs is a positive voltage, and a voltage lower than the sustaining voltage Vs is a negative voltage. The sustaining voltage Vs is set equal to about 170V, for instance. A reference voltage of the data electrodes 5 is set equal to zero (0) volt.

Figure 13:
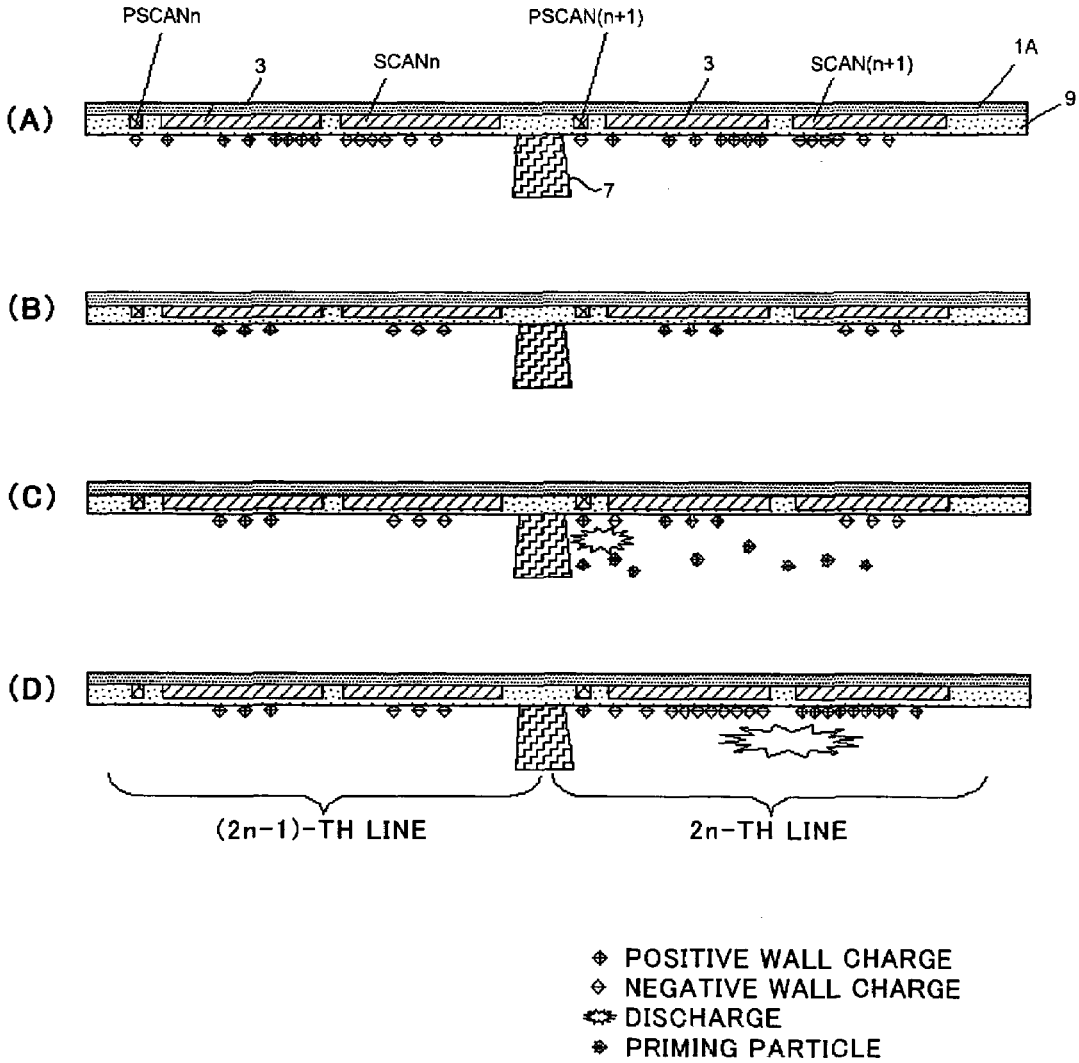
FIG. 13 is a cross-sectional view showing wall charges in a display cell in the plasma display panel in accordance with the fourth embodiment.

FIG. 13 is a cross-sectional view taken along the line XIII—XIII in FIG. 11 as viewed from "X". FIG. 13(A), (B), (C) and (D) indicate discharges and wall charges observed at the time A, B, C and D indicated in FIG. 12, respectively.

In FIG. 13, the preliminary scanning electrode 14 in a 2n-th line is indicates as "PSCAN 2n". In FIG. 13, the trace electrodes 4 and the rear substrate 1B are omitted for simplification.

In the preliminary discharge period (A), a positive serrate preliminary discharge pulse Pps is applied to both of the scanning electrodes 2 and the preliminary scanning electrodes 14, and concurrently, a negative rectangular preliminary discharge pulse Ppc is applied to the sustaining electrodes 3.

The preliminary discharge pulse Ppc has a voltage of zero (0).

Each of the preliminary discharge pulses Pps and Ppc is designed to have a wave-height greater than a threshold voltage at which discharge starts being generated between the scanning and sustaining electrodes 2 and 3 and further than a threshold voltage at which discharge starts being generated between the preliminary discharge electrode 14 and the sustaining electrode 3. Hence, weak discharge is generated between the scanning and sustaining electrodes 2 and 3 and further between the scanning electrodes 2 and the preliminary discharge electrode 14 when the preliminary discharge pulses Pps and Ppc are applied to the scanning electrodes 2, the preliminary discharge electrode 14 and the sustaining electrodes 3, and a voltage of the serrate preliminary discharge pulse Pps raises, thereby a voltage between the scanning and sustaining electrodes 2 and 3 and a voltage between the preliminary discharge electrode 14 and the sustaining electrodes 3 exceed the above-mentioned threshold voltages.

As a result, as illustrated in FIG. 13-(A), negative wall charges are accumulated above the scanning electrodes 2 and the preliminary scanning electrodes 14, and positive wall charges are accumulated above the sustaining electrodes 3.

Following the preliminary discharge pulse Pps, a negative serrate preliminary discharge-eliminating pulse Ppe is applied to the scanning electrodes 2 and the preliminary scanning electrodes 14. The sustaining electrodes 3 are kept at the sustaining voltage Vs.

By applying the negative serrate preliminary discharge-eliminating pulse Ppe to the scanning electrodes 2 and the preliminary scanning electrodes 14, wall charges having been accumulated above the scanning electrodes 2, the preliminary discharge electrode 14 and the sustaining electrodes 3 are eliminated.

Herein, the term "eliminate" should not be limited to elimination of all of wall charges, but should be interpreted as including reduction in wall charges for smoothly generating discharges in the scanning period (B) and the sustaining period (C).

In the scanning period (B), all of the scanning electrodes 2 are kept at a base voltage Vbw, and then, a negative scanning pulse Pw is applied to the scanning electrodes 2 one by one, and concurrently, a data pulse Pd is applied to the data electrodes 5 in accordance with data to be displayed.

The sustaining electrodes SUS-o are kept at a positive voltage Vsp when the scanning pulse Pw is applied to the K-th scanning electrode 2, or at a positive voltage Vsw when the scanning pulse Pw is applied to the L-th scanning electrode 2.

Ultimate voltages of the scanning pulse Pw and the data pulse Pd are determined such that a voltage across the scanning and data electrodes 2 and 5 does not exceed a threshold voltage at which discharge is generated between the scanning and data electrodes 2 and 5, if only one of the scanning pulse Pw and the data pulse Pd is applied to the scanning or data electrodes 2 or 5, but exceeds the threshold voltage, if both of the scanning pulse Pw and the data pulse Pd are applied to the scanning and data electrodes 2 and 5, respectively.

The voltage Vsw at which the sustaining electrodes 3 are kept in the scanning period (B) is determined such that a voltage across the scanning and sustaining electrodes 2 and 3 does not exceed a threshold voltage at which discharge is generated between the scanning and sustaining electrodes 2 and 3, even if the voltage Vsw is added to the scanning pulse Pw.

The voltage Vsp at which the sustaining electrodes 3 are kept in the scanning period (B) is determined such that a voltage across the priming electrodes 13 and the preliminary scanning electrodes 14 does not exceed a threshold voltage at which there is generated discharge between the priming electrodes 13 and the preliminary scanning electrodes 14, and hence, there is not generated discharge between the priming electrodes 13 and the preliminary scanning electrodes 14, if the preliminary scanning electrodes 14 (and hence, the scanning electrodes 2) are kept at the base voltage Vbw, but exceeds the above-mentioned threshold voltage, and hence, there is generated discharge between the priming electrodes 13 and the preliminary scanning electrodes 14, if the scanning pulse Pw is applied to the preliminary scanning electrodes 14 (and hence, the scanning electrodes 2).

Herein, each of a voltage across the facing electrodes such as the scanning electrodes 2 and the data electrodes 5 and a voltage across the surface electrodes such as the scanning electrodes 2 and the sustaining electrodes 3 is defined as a sum of an externally applied voltage and a voltage caused by wall charges accumulated in a display cell.

Accordingly, cross-discharge is generated between the scanning and data electrodes 2 and 5 only in a display cell in which the scanning pulse Pw is applied to the scanning electrodes 2 and the data pulse Pd is applied to the data electrodes 5.

When cross-discharge is generated between the scanning and data electrodes 2 and 5, since a voltage caused by the scanning pulse Pw and the voltage Vsw is applied across the scanning and sustaining electrodes 2 and 3, there is generated discharge also between the scanning and sustaining electrodes 2 and 3 with the cross-discharge acting as a trigger. The thus generated discharge is data-writing discharge.

As a result, positive wall charges are accumulated above the scanning electrode 2, and negative wall charges are accumulated above the sustaining electrodes 3 in a selected display cell.

Hereinbelow is explained in detail an operation in the scanning period (B).

When the scanning pulse Pw is applied to the (2n−1)-th line scanning electrode SCAN (2n−1) and the data pulse Pd is applied to the data electrode 5, there is generated data-writing discharge in display cells belonging to the (2n−1)-th line.

In the 2n-th line, a preliminary scanning pulse substantially identical with the (2n−1)-th line scanning pulse Pw is applied to the preliminary scanning electrodes 14 PSCAN 2n. Thus, since the sustaining electrodes 3 belonging to the 2n-th line is kept at the positive voltage Vsp, there is generated priming discharge in the 2n-th line between the preliminary scanning electrodes 14 and the priming electrode 13. FIG. 13-(C) shows priming discharge generated between the preliminary scanning electrodes 14 and the priming electrode 13 in the case that the data pulse Pd is not applied to the data electrodes 5.

The priming discharge is not so intensive, because the preliminary scanning electrodes 14 do not have a large area.

In addition, since the priming discharge is far away from the primary discharge gap MG in the 2n-th line, there is not generated erroneous discharge between the scanning and sustaining electrodes 2 and 3.

After the application of the scanning pulse Pw to the (2n−1)-th line scanning electrodes SCAN (2n−1) has terminated, the scanning pulse Pw is applied to the 2n-th line scanning electrode SCAN 2n.

Concurrently, the data pulse Pd is applied to the data electrodes 5 in a selected display cell. Then, there is generated discharge between the scanning electrode 2 and the data electrode 5, and the thus generated discharge triggers generation of discharge between the scanning and sustaining electrodes 2 and 3. As a result, positive wall charges are accumulated above the scanning electrode 2, and negative wall charges are accumulated above the sustaining electrode 3. FIG. 13D illustrates discharge generated between the scanning and sustaining electrodes 2 and 3 when the data pulse Pd is applied to the data electrodes 5.

In a (2n+1)-th line, the preliminary scanning pulse applied to the preliminary scanning electrode PSCAN (2n+1) causes generation of priming discharge between the preliminary scanning electrodes 14 and the priming electrode 13.

Then, in the sustaining period (C), all of the scanning electrodes 2 are kept at the sustaining voltage Vs, and the first sustaining pulse Psf is applied to the sustaining electrode 3.

The sustaining voltage Vs is determined to be such a voltage that if a voltage caused by wall charges accumulated above the surface electrodes 2 and 3 by data-writing discharge in the scanning period (B) is added to the sustaining voltage Vs, discharge will be generated between the surface electrodes 2 and 3, and if not, a voltage across the surface electrodes 2 and 3 will not exceed a threshold voltage, and hence, discharge is generated between the surface electrodes 2 and 3.

Accordingly, sustaining voltage is generated only in a display cell in which there has been generated data-writing discharge in the scanning period (B), and hence, wall charges have been accumulated on above the surface electrodes.

Then, sustaining pulses Ps having a wave-height equal to the sustaining voltage Vs and having phases inverted to each other are applied to the scanning and sustaining electrodes 2 and 3. As a result, there is generated sustaining voltage only in a display cell in which discharge has been generated by the first sustaining pulse Psf.

In the fourth embodiment, wall charges are accumulated due to the priming discharge between the preliminary scanning electrodes 14 and the sustaining electrode 3 even in a display cell into which data is not written, that is, a display cell belonging to the (2n−1)-th line in FIG. 13.

In the sustaining period (C), the sustaining pulse Ps is alternately applied to the priming gap PG formed between the preliminary scanning electrodes 14 and the sustaining electrode 3. Hence, the priming gap PG is determined such that a minimum voltage at which discharge is kept generated between the preliminary scanning electrodes 14 and the sustaining electrode 3 is equal to or greater than the sustaining voltage Vs.

In actual, since the preliminary scanning electrodes 14 has a quite small area, the priming gap PG may be designed to be equal to or smaller than the primary discharge gap MG.

In the subsequent sustaining period (D), the sustaining electrode 3 is kept at the sustaining voltage Vs, and a negative serrate sustaining-elimination pulse Pe is applied to the scanning electrode 2. As a result, wall charges having been accumulated above the surface electrodes 2 and 3 sandwiching the primary discharge gap MG therebetween are eliminated, and hence, the plasma display panel is returned back to its initial condition, that is, a condition observed prior to the application of the preliminary discharge pulses Pps and Ppc to the scanning and sustaining electrodes 2 and 3 in the preliminary discharge period (A).

Herein, the term "eliminate" should not be limited to elimination of all of wall charges, but should be interpreted as including reduction in wall charges for smoothly generating discharges in the subsequent periods.

Wall charges are reset above the surface electrodes 2 and 3 sandwiching the primary discharge gap MG therebetween in a preliminary discharge period (A) in the next sub-field, regardless of wall charge conditions.

In accordance with the fourth embodiment, it is possible not only to shorten the scanning period (B), but also to enlarge areas of the scanning and sustaining electrodes 2 and 3 acting as main discharge electrodes, since it is no longer necessary for the plasma display panel to include the priming electrode 13, ensuring that images can be displayed at a higher luminance.

[Fifth Embodiment]

Figure 14:
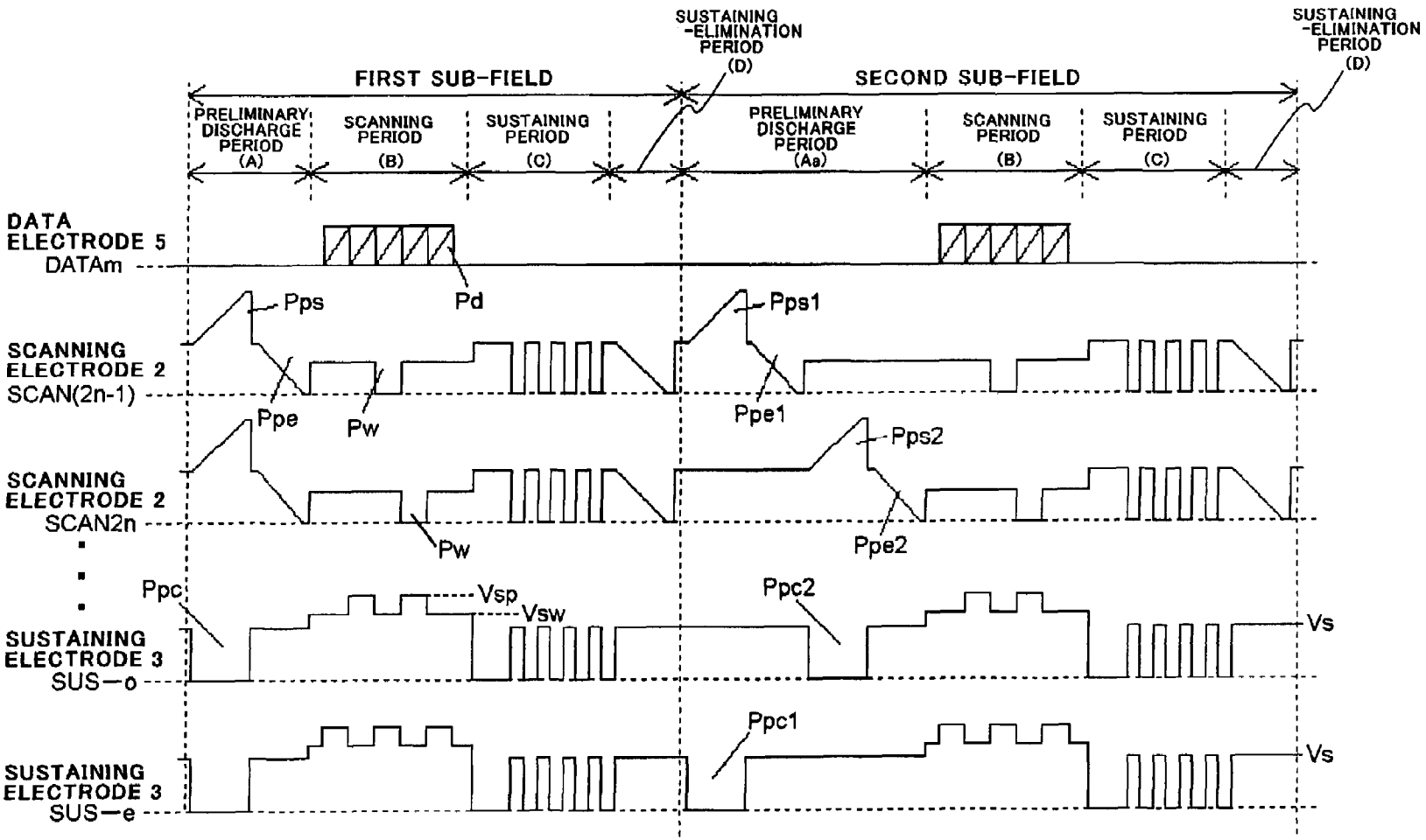
FIG. 14 is a timing chart showing waveforms of voltage pulses to be applied to electrodes in a method of driving the plasma display panel in accordance with the fifth embodiment.

FIG. 14 is a timing chart showing waveforms of voltage pulses to be applied to electrodes in a method of a plasma display panel in accordance with the fifth embodiment.

The plasma display panel in accordance with the fifth embodiment has the same structure as the same of the plasma display panel in accordance with the fourth embodiment, but is driven in a different way from the plasma display panel in accordance with the fourth embodiment.

FIG. 14 shows successive two sub-fields, namely, a first sub-field and a second sub-field.

Waveforms of voltage pulses to be applied to electrodes in the first sub-field are identical with the waveforms in the first embodiment. Hence, pulses having the same waveforms as the waveforms having been explained in the first embodiment are applied the scanning electrodes 2 and the sustaining electrodes 3.

In the preliminary discharge period (Aa) in the second sub-field, a waveform of a pulse to be applied to the scanning electrodes SCAN (2n−1) belonging to the K-th display lines is different from a waveform of a pulse to be applied to the scanning electrodes SCAN 2n belonging to the L-th display lines, and in addition, a waveform of a pulse to be applied to the sustaining electrodes SUS-o belonging to the K-th display lines is different from a waveform of a pulse to be applied to the sustaining electrodes SUS-e belonging to the L-th display lines.

In the preliminary discharge area (Aa), a first preliminary discharge pulse Pps1 is applied to the K-th scanning electrodes SCAN (2n−1), and a first preliminary discharge pulse Ppc1 is applied to the sustaining electrodes SUS-e. As a result, there is generated between the preliminary scanning electrodes 14 and the sustaining electrode 3 only in display cells in the L-th lines.

Then, the sustaining electrodes SUS-e are kept at the sustaining voltage Vs, and a first preliminary discharge-eliminating pulse Ppe1 is applied to the K-th scanning electrodes SCAN (2n−1). As a result, wall charges having been accumulated between the preliminary scanning electrodes 14 and the sustaining electrode 3 in display cells in the L-th lines are eliminated.

Since the scanning electrodes SCAN 2n belonging to the L-th display lines and the sustaining electrodes SUS-o are kept at the sustaining voltage Vs, there is not generated any discharge in the primary discharge gap MG.

Then, a second preliminary discharge pulse Pps2 is applied to the K-th scanning electrodes SCAN (2n−1), and a second preliminary discharge pulse Ppc2 is applied to the sustaining electrodes SUS-o. As a result, there is generated between the preliminary scanning electrodes 14 and the sustaining electrode 3 only in display cells in the K-th lines.

Then, the sustaining electrodes SUS-o are kept at the sustaining voltage Vs, and a second preliminary discharge-eliminating pulse Ppe2 is applied to the L-th scanning electrodes SCAN 2n. As a result, wall charges having been accumulated between the preliminary scanning electrodes 14 and the sustaining electrode 3 in display cells in the K-th lines are eliminated.

Since the K-th scanning electrodes SCAN (2n−1) and the L-th sustaining electrodes SUS-e are kept at the sustaining voltage Vs, there is not generated any discharge in the primary discharge gap MG.

Even if sustaining discharge is generated in the first sub-field, data-writing operation to be carried out in the subsequent scanning period (B) is not much influenced by the sustaining discharge, because wall charges have been already re-arranged in the primary discharge gap MG formed between the scanning and sustaining electrodes 2 and 3 in the sustain-elimination period (D) in the first sub-field.

There is generated preliminary discharge between the priming electrode 13 and the preliminary scanning electrode 14, similarly to the first sub-field. Hence, there is generated priming discharge in the scanning period (B), similarly to the first sub-field, ensuring a high discharge generation ratio and a shortened pulse width of the scanning pulse Pw.

In addition, there is not generated preliminary discharge in the second sub-field between the scanning and sustaining electrodes 2 and 3 both having a large area. Hence, even if light-emission is generated due to generation of discharge between the priming electrode 13 and the preliminary scanning electrode 14, it would be possible to lower a luminance in dark-display in comparison with the conventional methods. Accordingly, it would be possible to lower a luminance in dark-display and raise a contrast in darkness in comparison with the conventional methods by arranging one or more sub-field in one field which sub-field has the preliminary discharge area A in which preliminary discharge is generated in the discharge gap MG, and designing the rest of sub-fields to include the preliminary discharge area Aa in which preliminary discharge is generated only in the priming gap PG.

[Sixth Embodiment]

Figure 15:
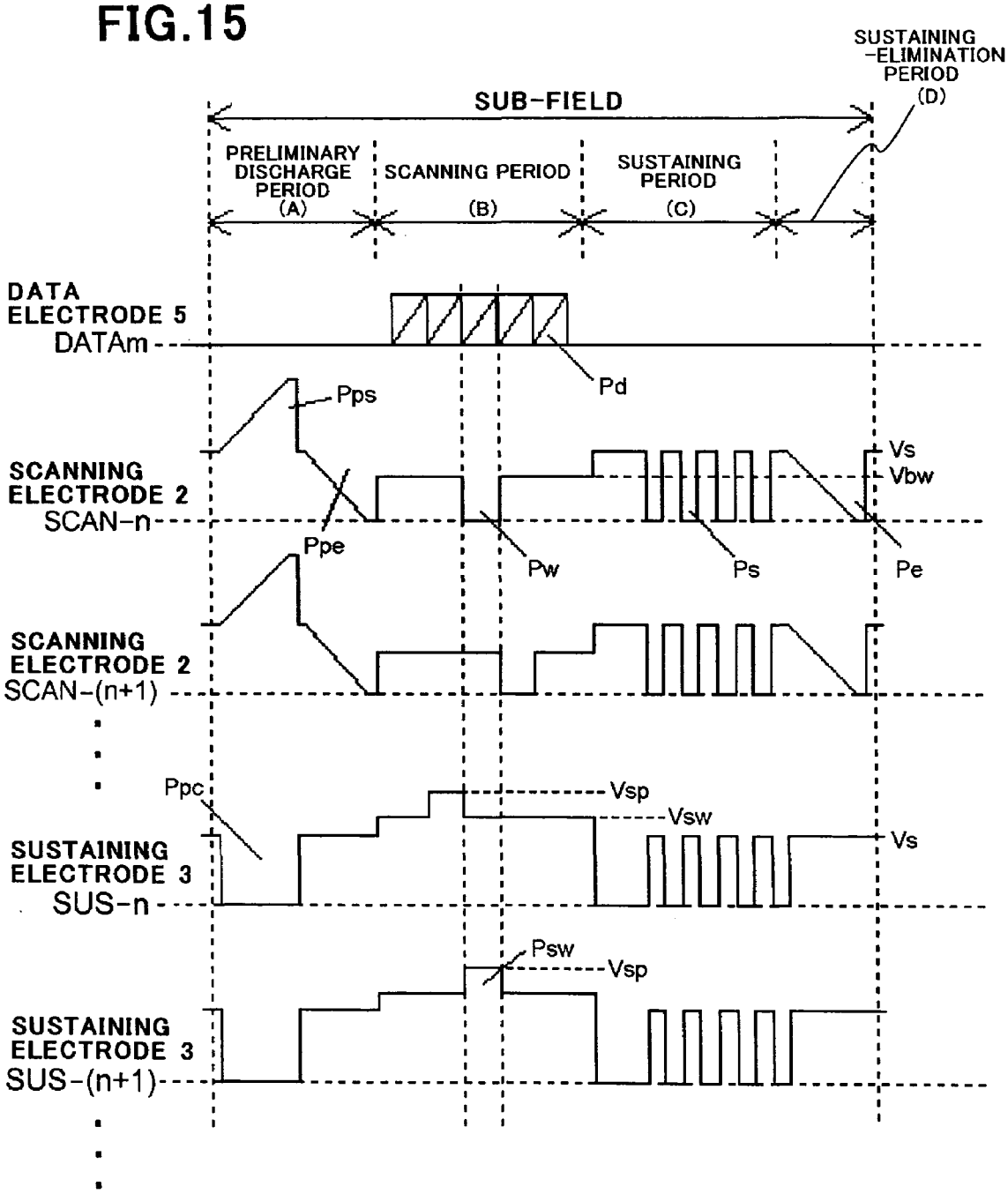
FIG. 15 is a timing chart showing waveforms of voltage pulses to be applied to electrodes in a method of driving the plasma display panel in accordance with the sixth embodiment.

FIG. 15 is a timing chart showing waveforms of voltage pulses to be applied to electrodes in a method of a plasma display panel in accordance with the sixth embodiment.

The plasma display panel in accordance with the sixth embodiment has the same structure as the same of the plasma display panel in accordance with the fourth embodiment, but is driven in a different way from the plasma display panel in accordance with the fourth embodiment.

Waveforms of pulses to be applied to the electrodes in the preliminary discharge period (A), the sustaining period (C) and the sustaining-elimination period (D) in the sixth embodiment are identical with those in the fourth embodiment. Only a waveform of a pulse to be applied to the sustaining electrode 3 in the scanning period (B) is different from that in the fourth embodiment. That is, the sustaining electrodes 3 are driven separately for each of the display lines in the sixth embodiment.

In the scanning period (B), all of the sustaining electrodes 3 are once kept at the voltage Vsw, and then, the scanning pulse Pw is applied to the scanning electrodes SCANn in the n-th line, and concurrently, the preliminary scanning pulse Pws having a voltage of Vsp is applied to the sustaining electrodes SUS (n+1) in the (n+1)-th line. Thus, there is generated priming discharge between the preliminary scanning electrode 14 and the sustaining electrode 3 in the (n+1)-th line, and a discharge generation ratio at which data-writing is carried out in the next (n+1)-th line is raised.

A plasma display panel is accompanied with a problem that since it is a capacitive device, electricity is charged into and discharged from capacity as a voltage varies, power which does not contribute to light emission is increased.

In the fourth embodiment, a voltage of the sustaining electrode 3 is switched between the voltages Vsw and Vsp every pulse width of the scanning pulse Pw in the scanning period (B). Hence, it was difficult in the fourth embodiment to reduce power which does not contribute to light emission.

In contrast, in accordance with the sixth embodiment, a voltage of each of the sustaining electrodes 3 varies only once from the voltage Vsw to the voltage Vsp in the scanning period (B). Accordingly, it is possible to significantly reduce power consumed in vain when electricity is charged into and discharged from capacity, in comparison with the fourth embodiment.

[Seventh Embodiment]

Figure 16:
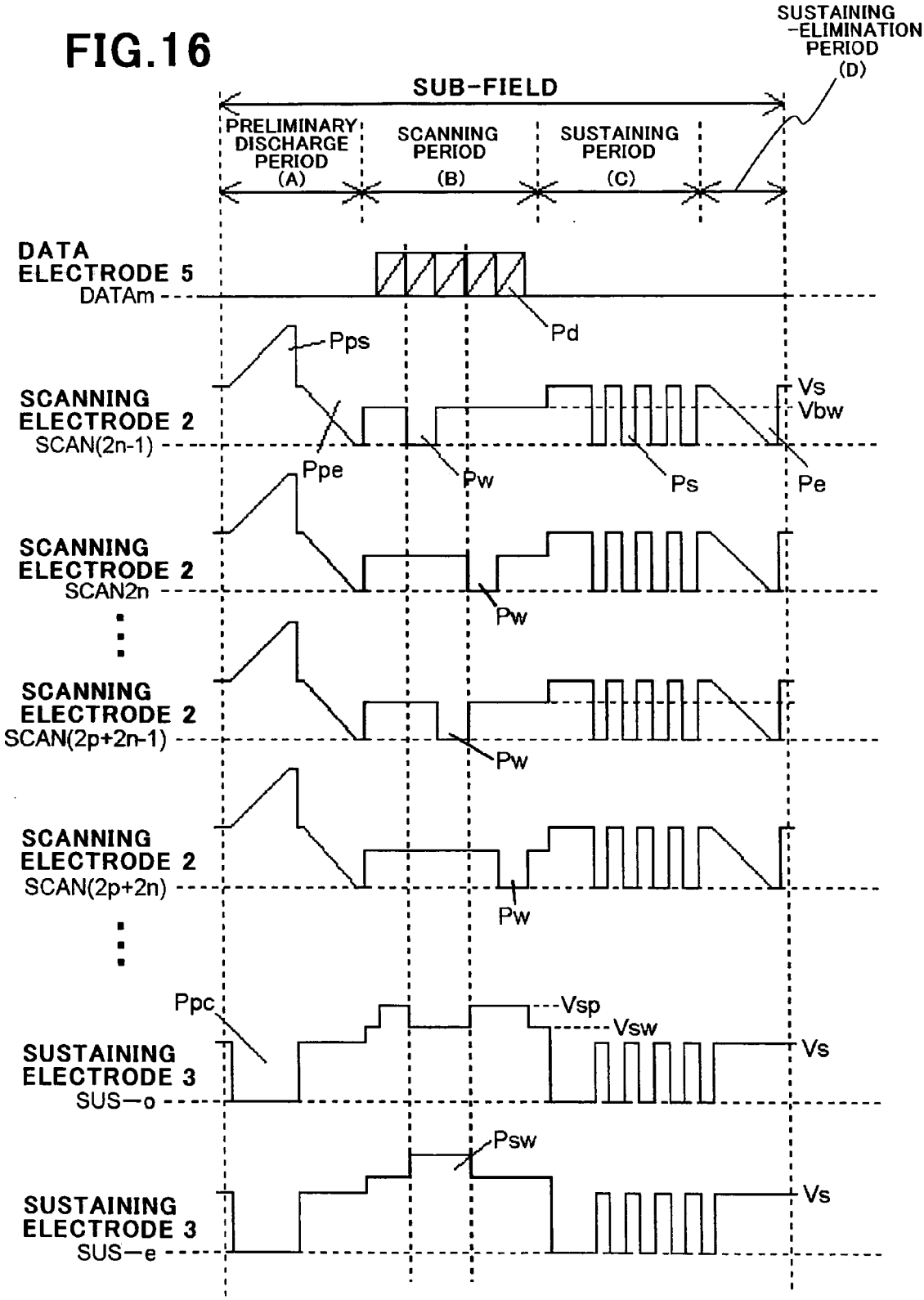
FIG. 16 is a timing chart showing waveforms of voltage pulses to be applied to electrodes in a method of driving the plasma display panel in accordance with the seventh embodiment.

FIG. 16 is a timing chart showing waveforms of voltage pulses to be applied to electrodes in a method of a plasma display panel in accordance with the seventh embodiment.

The plasma display panel in accordance with the seventh embodiment has the same structure as the same of the plasma display panel in accordance with the fourth embodiment, but is driven in a different way from the plasma display panel in accordance with the fourth embodiment.

Waveforms of pulses to be applied to the electrodes in the preliminary discharge period (A), the sustaining period (C) and the sustaining-elimination period (D) in the seventh embodiment are identical with those in the fourth embodiment. An order by which the scanning pulse Pw is applied to the scanning electrodes 2 in the scanning period (B) is different from the same in the fourth embodiment.

That is, the plasma display panel in the seventh embodiment is divided into an upper half and a lower half, into which the scanning pulse Pw is alternately applied.

If a number of display lines is 4p, for instance, the scanning pulse Pw is applied to a first line, a (2p+1)-th line, a second line and a (2p+2)-th line in this order. Hence, the scanning pulse Pw is applied to a (2p+2n−1)-th line between a (2n−1)-th line and a 2n-th line both illustrated in FIG. 16.

By applying the scanning pulse Pw in the above-mentioned order, the scanning pulse Pw is applied to every two K-th and L-th lines wherein K is an odd number and L is an even number. Specifically, the scanning pulse Pw is applied to a K-th line, a K-th line, a L-th line and a L-th line in one cycle, for instance. Hence, a cycle at which the voltage Vsp or Vsw to be applied to the sustaining electrode 3 is switched is equal to 2W wherein W indicates a pulse width of the scanning pulse.

As having been stated in the sixth embodiment, since a plasma display panel is a capacitive device, power is consumed in vain as a voltage varies. In accordance with the seventh embodiment, the K-th lines are scanned every two lines, and similarly, the L-th lines are scanned every two lines. Hence, a cycle at which a voltage of the sustaining electrode 3 varies is twice greater than the same in the fourth embodiment, and accordingly, a number by which the voltage varies is reduced to about a half of a number in the fourth embodiment. Thus, electric power consumed in vain due to charge and discharge can be reduced to about a half in comparison with the fourth embodiment.

The plasma display panel in accordance with the above-mentioned sixth embodiment was necessary to include driver circuits for individually driving the sustaining electrodes 3. In contrast, the plasma display panel in accordance with the seventh embodiment can drive the sustaining electrodes 3 without such driver circuits, ensuring reduction in power consumption without an increase in circuitry costs.

In the method of driving the plasma display panel in accordance with the seventh embodiment, a period of time until the application of the scanning pulse Pw to the associated display line from the generation of the priming discharge between the preliminary scanning electrode 14 and the sustaining electrode 3 is later by one scanning cycle than the same in the fourth embodiment.

However, since priming particles formed by priming discharge are attenuated under a time constant of about ten or more microseconds, a discharge generation ratio can be improved, if a time difference is equal to or smaller than 100 microseconds. In addition, if a time difference is equal to or smaller than 20 microseconds, a quite high discharge generation ratio can be obtained.

A display area is divided into two areas in the seventh embodiment. However, it should be noted that a display area may be divided into three or more areas.

For instance, it is assumed that a scanning cycle is 1.5 microseconds, in which case, even if a display area is divided into ten areas and the scanning pulse Pw is applied to the ten areas in turn, a period of time until data writing from priming discharge would be 15 microseconds. Thus, it is possible to carry out data-writing operation at a high discharge generation ratio. Specifically, a voltage of the sustaining electrode 3 varies in the scanning period (B) to a degree about ten times smaller than a degree to which a voltage of the sustaining electrode 3 varies in the fourth embodiment, ensuring significant reduction in wastefully consumed power.

In the above-mentioned first to seventh embodiments, the preliminary scanning electrode 14, the priming electrode 13 and the sustaining electrode 3 may be composed partially or wholly of a material which does not allow a visible light to pass therethrough.

In the above-mentioned first to seventh embodiments, main discharge for light emission is generated between electrodes commonly formed on a substrate. However, it should be noted that the present invention may be applied not only to such a structure, but also to a structure in which main discharge is generated between electrodes formed on separate substrates, or to a plasma display panel having a similar structure.

Two or more among the above-mentioned first to seventh embodiments may be combined with one another.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2002-357518 filed on Dec. 10, 2002 including specification, claims, drawings and summary is incorporated herein by reference in its entirety.

What is claimed is:

1. A plasma display panel including:

(a) a first substrate;

(b) a second substrate facing said first substrate;

(c) a plurality of first electrodes formed on a surface of said first substrate which surface faces said second electrode, said first electrodes extending in parallel with one another in a first direction, and each having an input terminal through which a pulse is input thereinto;

(d) a plurality of second electrodes formed on a surface of said second substrate which surface faces said first electrode, said second electrodes extending in parallel with one another in a second direction perpendicular to said first direction, and each having an input terminal through which a pulse is input thereinto; and (e) a plurality of display cells arranged at intersections of said first electrodes with said second electrodes, wherein a first selection pulse is input into said first electrodes and a second selection pulse is input selectively into one or more of said second electrodes to thereby control whether light is to be emitted in each of said display cells, and at least one of said display cells has a third electrode formed on said first substrate and being electrically connected to a first electrode other than a first electrode belonging to a display cell to which said third electrode belongs.

2. The plasma display panel as set forth in claim 1, wherein said third electrode is at least partially composed of a material which does not allow a visible light to pass therethrough.

3. A plasma display panel including:

(a) a first substrate;

(b) a second substrate facing said first substrate;

(c) a plurality of first electrodes formed on a surface of said first substrate which surface faces said second electrode, said first electrodes extending in parallel with one another in a first direction, and each having an input terminal through which a pulse is input thereinto;

(d) a plurality of second electrodes formed on a surface of said second substrate which surface faces said first electrode, said second electrodes extending in parallel with one another in a second direction perpendicular to said first direction, and each having an input terminal through which a pulse is input thereinto;

(e) a plurality of fourth electrodes extending in parallel with said first electrodes with a primary discharge gap being sandwiched therebetween; and (f) a plurality of display cells arranged at intersections of said first and fourth electrodes with said second electrodes, wherein a first selection pulse is input into said first electrodes and a second selection pulse is input selectively into one or more of said second electrodes to thereby control whether light is to be emitted in each of said display cells, and at least one of said display cells has a third electrode formed on said first substrate and being electrically connected to a first electrode other than a first electrode belonging to a display cell to which said third electrode belongs.

4. The plasma display panel as set forth in claim 3, wherein said third and fourth electrodes form a preliminary display gap therebetween.

5. The plasma display panel as set forth in claim 4, wherein said third and fourth electrodes are at least partially composed of a material which does not allow a visible light to pass therethrough.

6. The plasma display panel as set forth in claim 4, further comprising a light-shielding layer formed at least partially on said first substrate in alignment with said preliminary discharge gap, said light-shielding layer having opaqueness to a visible light.

7. A plasma display panel including:

(a) a first substrate;

(b) a second substrate facing said first substrate;

(c) a plurality of first electrodes formed on a surface of said first substrate which surface faces said second electrode, said first electrodes extending in parallel with one another in a first direction, and each having an input terminal through which a pulse is input thereinto;

(d) a plurality of second electrodes formed on a surface of said second substrate which surface faces said first electrode, said second electrodes extending in parallel with one another in a second direction perpendicular to said first direction, and each having an input terminal through which a pulse is input thereinto;

(e) a plurality of fourth electrodes extending in parallel with said first electrodes with a primary discharge gap being sandwiched therebetween;

(f) a plurality of fifth electrodes extending in parallel with said first and fourth electrodes; and (g) a plurality of display cells arranged at intersections of said first and fourth electrodes with said second electrodes, wherein a first selection pulse is input into said first electrodes and a second selection pulse is input selectively into one or more of said second electrodes to thereby control whether light is to be emitted in each of said display cells, and at least one of said display cells has a third electrode formed on said first substrate and being electrically connected to a first electrode other than a first electrode belonging to a display cell to which said third electrode belongs.

8. The plasma display panel as set forth in claim 7, wherein said third and fifth electrodes form a preliminary display gap therebetween.

9. The plasma display panel as set forth in claim 8, wherein said third and fifth electrodes are at least partially composed of a material which does not allow a visible light to pass therethrough.

10. The plasma display panel as set forth in claim 8, further comprising a light-shielding layer formed at least partially on said first substrate in alignment with said preliminary discharge gap, said light-shielding layer having opaqueness to a visible light.

11. A method of driving a plasma display panel including:

(a) a first substrate;

(b) a second substrate facing said first substrate;

(c) a plurality of first electrodes formed on a surface of said first substrate which surface faces said second electrode, said first electrodes extending in parallel with one another in a first direction, and each having an input terminal through which a pulse is input thereinto;

(d) a plurality of second electrodes formed on a surface of said second substrate which surface faces said first electrode, said second electrodes extending in parallel with one another in a second direction perpendicular to said first direction, and each having an input terminal through which a pulse is input thereinto; and (e) a plurality of display cells arranged at intersections of said first electrodes with said second electrodes, wherein a first selection pulse is input into said first electrodes and a second selection pulse is input selectively into one or more of said second electrodes to thereby control whether light is to be emitted in each of said display cells, and at least one of said display cells has a third electrode formed on said first substrate and being electrically connected to a first electrode A other than a first electrode B belonging to a display cell to which said third electrode belongs, said method including the steps of:

(a) in at least one of said display cells having said third electrode, by the application of said first selection pulse to said first electrode A, generating priming discharge at a third electrode in said display cell; and (b) applying said first selection pulse to said first electrode B subsequently to said step (a).

12. The method as set forth in claim 11, further including the step of composing said third electrode at least partially of a material which does not allow a visible light to pass therethrough.

13. A method of driving a plasma display panel including:

(a) a first substrate;

(b) a second substrate facing said first substrate;

(c) a plurality of first electrodes formed on a surface of said first substrate which surface faces said second electrode, said first electrodes extending in parallel with one another in a first direction, and each having an input terminal through which a pulse is input thereinto;

(d) a plurality of second electrodes formed on a surface of said second substrate which surface faces said first electrode, said second electrodes extending in parallel with one another in a second direction perpendicular to said first direction, and each having an input terminal through which a pulse is input thereinto;

(e) a plurality of fourth electrodes extending in parallel with said first electrodes with a primary discharge gap being sandwiched therebetween; and (f) a plurality of display cells arranged at intersections of said first and fourth electrodes with said second electrodes, wherein a first selection pulse is input into said first electrodes and a second selection pulse is input selectively into one or more of said second electrodes to thereby control whether light is to be emitted in each of said display cells, and at least one of said display cells has a third electrode formed on said first substrate and being electrically connected to a first electrode A other than a first electrode B belonging to a display cell to which said third electrode belongs, said method including the steps of:

(a) in at least one of said display cells having said third electrode, by the application of said first selection pulse to said first electrode A, generating priming discharge at a third electrode in said display cell; and (b) applying said first selection pulse to said first electrode B subsequently to said step (a).

14. The method as set forth in claim 13, further including the step of forming a preliminary discharge gap between said third and fourth electrodes, wherein said priming discharge is generated at said preliminary discharge gap.

15. The method as set forth in claim 14, further including the steps of:

keeping a fourth electrode of said display cell at a voltage at which discharge is generated at said preliminary discharge gap, in at least a part of a period in which said first selection pulse is applied to said third electrode of said display cell; and keeping said fourth electrode of said display cell at a voltage at which discharge is not generated at said preliminary discharge gap, in a period in which said first selection pulse is applied to said first electrode of said display cell.

16. The method as set forth in claim 15, further including the step of dividing said display cells into a plurality of display cell groups such that a display cell including a third cell and a display cell including a first electrode electrically connected to said third electrode do not belong to a common group, and dividing said fourth electrodes into a plurality of electrode groups such that fourth electrodes in each of said display cell groups belong to a common electrode group for controlling a voltage of said fourth electrode in each of said electrode groups.

17. The method as set forth in claim 16, further including the step of successively applying said first selection pulse a plurality of times to a plurality of said third electrodes belonging to any one of said display cell groups.

18. The method as set forth in claim 15, further including the step of keeping said fourth electrode of said display cell at a voltage at which discharge is not generated at said preliminary discharge gap, in a period in which said first selection pulse is applied to said first electrode A of said display cell.

19. The method as set forth in claim 13, wherein a field is divided into a plurality of sub-fields including at least the step of applying said first selection pulse, at least one sub-field among said sub-fields includes the step of carrying out first initialization which step includes the sub-step of carrying out initialization at said primary discharge gap, and at least one sub-field among said sub-fields includes the step of carrying out second initialization which step includes the sub-step of carrying out initialization at said primary discharge gap, but does not include the sub-step of carrying out initialization at said primary discharge gap.

20. The method as set forth in claim 14, further comprising the step of composing said third and fourth electrodes at least partially of a material which does not allow a visible light to pass therethrough.

21. The method as set forth in claim 13, further comprising the step of forming a light-shielding layer at least partially on said first substrate in alignment with said preliminary discharge gap, said light-shielding layer having opaqueness to a visible light.

22. The method as set forth in claim 13, wherein a period of time from the generation of said priming discharge in said display cell until the application of said first selection pulse to said first electrode belonging to said display cell is equal to or smaller than 100 microseconds.

23. The method as set forth in claim 22, wherein said period of time is equal to or smaller than 20 microseconds.

24. A method of driving a plasma display panel including:

(a) a first substrate;

(b) a second substrate facing said first substrate;

(c) a plurality of first electrodes formed on a surface of said first substrate which surface faces said second electrode, said first electrodes extending in parallel with one another in a first direction, and each having an input terminal through which a pulse is input thereinto;

(d) a plurality of second electrodes formed on a surface of said second substrate which surface faces said first electrode, said second electrodes extending in parallel with one another in a second direction perpendicular to said first direction, and each having an input terminal through which a pulse is input thereinto;

(e) a plurality of fourth electrodes extending in parallel with said first electrodes with a primary discharge gap being sandwiched therebetween;

(f) a plurality of fifth electrodes extending in parallel with said first and fourth electrodes; and (g) a plurality of display cells arranged at intersections of said first and fourth electrodes with said second electrodes, wherein a first selection pulse is input into said first electrodes and a second selection pulse is input selectively into one or more of said second electrodes to thereby control whether light is to be emitted in each of said display cells, and at least one of said display cells has a third electrode formed on said first substrate and being electrically connected to a first electrode A other than a first electrode B belonging to a display cell to which said third electrode belongs, said method including the steps of:

(a) in at least one of said display cells having said third electrode, by the application of said first selection pulse to said first electrode A, generating priming discharge at a third electrode in said display cell; and (b) applying said first selection pulse to said first electrode B subsequently to said step (a).

25. The method as set forth in claim 24, further including the step of forming a preliminary discharge gap between said third and fifth electrodes, wherein said priming discharge is generated at said preliminary discharge gap.

26. The method as set forth in claim 24, wherein a field is divided into a plurality of sub-fields including at least the step of applying said first selection pulse, at least one sub-field among said sub-fields includes the step of carrying out first initialization which step includes the sub-step of carrying out initialization at said primary discharge gap, and at least one sub-field among said sub-fields includes the step of carrying out second initialization which step includes the sub-step of carrying out initialization at said primary discharge gap, but does not include the sub-step of carrying out initialization at said primary discharge gap.

27. The method as set forth in claim 24, further comprising the step of composing said third and fifth electrodes at least partially of a material which does not allow a visible light to pass therethrough.

28. The method as set forth in claim 24, further comprising the step of forming a light-shielding layer at least partially on said first substrate in alignment with said preliminary discharge gap, said light-shielding layer having opaqueness to a visible light.

29. The method as set forth in claim 24, wherein a period of time from the generation of said priming discharge in said display cell until the application of said first selection pulse to said first electrode belonging to said display cell is equal to or smaller than 100 microseconds.

30. The method as set forth in claim 29, wherein said period of time is equal to or smaller than 20 microseconds.

* * * * *